US011293428B2

(12) United States Patent
Tanaka

(10) Patent No.: US 11,293,428 B2
(45) Date of Patent: Apr. 5, 2022

(54) PUMP AND FLUID CONTROL DEVICE

(71) Applicant: Murata Manufacturing Co., Ltd., Kyoto (JP)

(72) Inventor: Nobuhira Tanaka, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 9 days.

(21) Appl. No.: 16/922,036

(22) Filed: Jul. 7, 2020

(65) Prior Publication Data

US 2020/0332790 A1 Oct. 22, 2020

Related U.S. Application Data

(63) Continuation of application No. PCT/JP2018/041610, filed on Nov. 9, 2018.

(30) Foreign Application Priority Data

Jan. 10, 2018 (JP) ..... JP2018-001964

(51) Int. Cl.
*F04B 45/04* (2006.01)
*F04B 45/047* (2006.01)
(Continued)

(52) U.S. Cl.
CPC ..... *F04B 45/045* (2013.01); *F04B 43/04* (2013.01); *F04B 45/047* (2013.01); *F04B 45/10* (2013.01)

(58) Field of Classification Search
CPC ..... F04B 43/04; F04B 45/045; F04B 45/047; F04B 45/10
See application file for complete search history.

(56) References Cited

U.S. PATENT DOCUMENTS 2,029,374 A * 2/1936 Houston ..... F04B 45/047 417/413.1
2009/0087323 A1* 4/2009 Blakey ..... F04F 7/00 417/413.2
2011/0280755 A1 11/2011 Wackerle et al.

FOREIGN PATENT DOCUMENTS

DE 589398 * 11/1933
JP H01219369 A 9/1989
(Continued)

OTHER PUBLICATIONS

International Search Report issued in Application No. PCT/JP2018/041610, dated Jan. 29, 2019.
(Continued)

*Primary Examiner* — Charles G Freay
(74) *Attorney, Agent, or Firm* — Pearne & Gordon LLP

(57) ABSTRACT

A pump includes a first pump chamber defined by a first plate-shaped body and a second plate-shaped body, a second pump chamber defined by the first plate-shaped body and a third plate-shaped body, and a driving body. The driving body causes a pressure fluctuation, by causing the first plate-shaped body to undergo bending vibration, in both the first pump chamber and the second pump chamber. The first plate-shaped body is provided with a plurality of first hole portions that does not overlap with an axis orthogonal to the central portion of the first plate-shaped body, and a check valve is attached to each of the plurality of first hole portions. The second plate-shaped body and the third plate-shaped body are respectively provided with second hole portions and third hole portions, and no check valve is attached to the second hole portions and the third hole portions.

24 Claims, 10 Drawing Sheets

(51) Int. Cl.
*F04B 43/04* (2006.01)
*F04B 45/10* (2006.01)

(56) References Cited

FOREIGN PATENT DOCUMENTS

| | | | | |
|---|---|---|---|---|
| JP | 2007092677 | A | | 4/2007 |
| JP | 2008537057 | A | | 9/2008 |
| JP | 2010230015 | A | | 10/2010 |
| WO | 2006/111775 | A1 | † | 10/2006 |
| WO | 2013/117945 | A1 | † | 8/2013 |
| WO | 2016013390 | A1 | | 1/2016 |

OTHER PUBLICATIONS

Written Opinion issued in Application No. PCT/JP2018/041610, dated Jan. 29, 2019.

* cited by examiner
† cited by third party

PUMP AND FLUID CONTROL DEVICE

This is a continuation of International Application No. PCT/JP2018/041610 filed on Nov. 9, 2018 which claims priority from Japanese Patent Application No. 2018-001964 filed on Jan. 10, 2018. The contents of these applications are incorporated herein by reference in their entireties.

BACKGROUND OF THE DISCLOSURE

Field of the Disclosure

The present disclosure relates to a displacement type pump using bending vibration of a vibration plate and a fluid control device including the same, and particularly relates to a piezoelectric pump using a piezoelectric element as a driving body for driving a vibration plate and a fluid control device including the same.

Description of the Related Art

An existing piezoelectric pump which is a kind of a displacement type pump has been known. The piezoelectric pump has a configuration in which at least part of a pump chamber is defined by a vibration plate to which a piezoelectric element is affixed, and is such that the vibration plate is driven at a resonant frequency by applying an AC voltage having a predetermined frequency to the piezoelectric element, which leads a pressure fluctuation in the pump chamber and makes it possible to perform suction and discharge of fluid.

As a document in which one configuration example of a piezoelectric pump is disclosed, there is, for example, International Publication No. 2016/013390 specification (Patent Document 1). In the piezoelectric pump disclosed in Patent Document 1, a configuration in which a pump chamber is defined by a pair of vibration plates arranged so as to face each other and a piezoelectric element is affixed to one of the pair of vibration plates is employed.

In the piezoelectric pump disclosed in Patent Document 1 described above, one hole portion to which a check valve is attached is provided in the central portion of the vibration plate to which the piezoelectric element is not affixed of the pair of vibration plates, and the plurality of hole portions annularly arranged in a point sequence manner is provided in an intermediate portion excluding the central portion and a peripheral portion of the vibration plate to which the piezoelectric element is affixed of the pair of vibration plates.

Here, in one form of the piezoelectric pump disclosed in Patent Document 1 described above, a configuration in which a check valve is attached to each of the plurality of hole portions which is annularly arranged in a point sequence manner as described above is employed, and in another form, a configuration in which a check valve is not attached to each of the plurality of hole portions is employed.

In the piezoelectric pump according to any form described above, a pressure fluctuation occurs in the pump chamber by the pair of vibration plates being caused to undergo bending vibration so as to be displaced in the reverse directions by the piezoelectric element, in accordance with the pressure fluctuation of the pump chamber, fluid located outside the pump chamber is sucked from the plurality of hole portions provided in the vibration plate to which the piezoelectric element is affixed, and then the fluid is discharged from the one hole portion provided in the vibration plate to which the piezoelectric element is not affixed, whereby a pump function is exerted.

Patent Document 1: International Publication No. 2016/013390 specification

BRIEF SUMMARY OF THE DISCLOSURE

Here, the hole portion to which the check valve is attached is larger in flow path resistance by an amount corresponding to a narrowed flow path than the hole portion to which the check valve is not attached. Accordingly, as in the piezoelectric pump disclosed in Patent document 1 described above, in the case where the configuration in which the hole portion to which the check valve is attached is provided in the central portion of the vibration plate is employed, a flow rate of the piezoelectric pump as a whole is determined by the hole portion, and increasing the flow rate is inevitably limited.

In order to avoid this, in a case where the configuration in which a plurality of hole portions to each of which the check valve is attached is simply provided in the intermediate portion excluding the central portion and the peripheral edge portion of the vibration plate is employed, the flow path resistance is largely reduced, but a displacement amount during driving of the vibration plate in the intermediate portion is smaller than that in the central portion, and thus a problem that the opening/closing itself of the check valve is not sufficient occurs. Therefore, even when the above-described configuration is employed, it is difficult to increase the flow rate of the piezoelectric pump as a whole.

Accordingly, the present disclosure has been made in view of the above-described problems, and an object thereof is to increase a flow rate in a displacement type pump using bending vibration of a vibration plate and a fluid control device including the same, as compared with the existing technique.

A pump according to the present disclosure includes: a first plate-shaped body; a second plate-shaped body; a third plate-shaped body; a first peripheral wall portion; a second peripheral wall portion; a first pump chamber; a second pump chamber; and a driving body. The second plate-shaped body faces the first plate-shaped body. The third plate-shaped body is located on an opposite side to a side on which the second plate-shaped body is located when viewed from the first plate-shaped body, and faces the first plate-shaped body. The first peripheral wall portion connects a peripheral edge portion of the first plate-shaped body and a peripheral edge portion of the second plate-shaped body to each other. The second peripheral wall portion connects a peripheral edge portion of the first plate-shaped body and a peripheral edge portion of the third plate-shaped body to each other. The first pump chamber is located between the first plate-shaped body and the second plate-shaped body, and is defined by the first plate-shaped body, the second plate-shaped body, and the first peripheral wall portion. The second pump chamber is located between the first plate-shaped body and the third plate-shaped body, and is defined by the first plate-shaped body, the third plate-shaped body, and the second peripheral wall portion. The driving body causes a pressure fluctuation, by causing the first plate-shaped body to undergo bending vibration, in both the first pump chamber and the second pump chamber. The first plate-shaped body is provided with a plurality of first hole portions to each of which a check valve is attached, and each of the plurality of first hole portions is arranged, when viewed along an extending direction of an axis orthogonal to a central portion of the first plate-shaped body, in a region that does not overlap with the axis. At least one of the second plate-shaped body and the first peripheral wall portion is provided with one or a plurality of second hole portions to each of which a check valve is not attached. At least one of the third plate-shaped body and the second peripheral wall portion is provided with one or a plurality of third hole portions to each of which a check valve is not attached.

In the pump according to the present disclosure, it is preferable that the one or plurality of second hole portions be arranged in a region that does not overlap with each of the plurality of first hole portions, when viewed along the extending direction of the axis.

In the pump according to the present disclosure, it is preferable that the one or plurality of third hole portions be arranged in a region that does not overlap with each of the plurality of first hole portions, when viewed along the extending direction of the axis.

In the pump according to the present disclosure, the driving body may cause, such that an antinode of vibration is formed in the central portion of the first plate-shaped body, the first plate-shaped body to undergo bending vibration such that a standing wave is generated in the first plate-shaped body with the axis as a center, and in that case, it is preferable that each of the plurality of first hole portions be arranged in a region that does not overlap with a node of vibration formed in the first plate-shaped body.

In the pump according to the present disclosure, it is preferable that the plurality of first hole portions be arranged, in a point sequence shape, at positions on a circumference with the axis as a center, when viewed along the extending direction of the axis.

In the pump according to the present disclosure, it is preferable that a distance between adjacent first hole portions of the plurality of first hole portions be smaller than a distance between the axis and each of the plurality of first hole portions.

In the pump according to the present disclosure, the first plate-shaped body may be caused to undergo bending vibration by the driving body such that an antinode of vibration is formed also at a position excluding the central portion of the first plate-shaped body.

In the pump according to the present disclosure, it is preferable that at least one of the plurality of first hole portions be arranged in a region that overlaps with the antinode of vibration formed at the position excluding the central portion of the first plate-shaped body.

In the pump according to the present disclosure, it is more preferable that each of the plurality of first hole portions be arranged in the region that overlaps with the antinode of vibration formed at the position excluding the central portion of the first plate-shaped body.

In the pump according to the present disclosure, each of the plurality of first hole portions may be arranged in a region in an outer side portion relative to a node of vibration formed at a position farthest from the central portion of the first plate-shaped body, among nodes of vibration formed in a region excluding the peripheral edge portion of the first plate-shaped body.

In the pump according to the present disclosure, it is preferable that the one or plurality of second hole portions be arranged in a region that does not overlap with the antinode of vibration formed in the first plate-shaped body, when viewed along the extending direction of the axis.

In the pump according to the present disclosure, it is more preferable that the one or plurality of second hole portions be arranged in a region that overlaps with the node of vibration formed in the first plate-shaped body, when viewed along the extending direction of the axis.

In the pump according to the present disclosure, it is preferable that the one or plurality of third hole portions be arranged in a region that does not overlap with the antinode of vibration formed in the first plate-shaped body, when viewed along the extending direction of the axis.

In the pump according to the present disclosure, it is more preferable that the one or plurality of third hole portions be arranged in a region that overlaps with the node of vibration formed in the first plate-shaped body, when viewed along the extending direction of the axis.

In a first aspect to a third aspect of the pump according to the present disclosure, the driving body causes, such that an antinode of vibration is formed in the central portion of the first plate-shaped body, the first plate-shaped body to undergo bending vibration such that a standing wave is generated in the first plate-shaped body with the axis as a center, each of the plurality of first hole portions is arranged in a region that does not overlap with a node of vibration formed in the first plate-shaped body, and furthermore, a plurality of the second hole portions is provided and a plurality of the third hole portions is provided. Furthermore, the plurality of first hole portions is arranged, in a point sequence shape, at positions on a circumference with the axis as a center, when viewed along the extending direction of the axis. Furthermore, the plurality of second hole portions is arranged, in a point sequence shape, at positions on a circumference with the axis as the center, when viewed along the extending direction of the axis, and the plurality of third hole portions is arranged, in a point sequence shape, at positions on a circumference with the axis as the center, when viewed along the extending direction of the axis.

In the first aspect, the plurality of second hole portions is all arranged in a region that does not overlap with each of the plurality of first hole portions when viewed along the extending direction of the axis, and the plurality of third hole portions is all arranged in a region that does not overlap with each of the plurality of first hole portions when viewed along the extending direction of the axis.

In the first aspect, the first plate-shaped body may be caused to undergo bending vibration by the driving body such that one antinode of vibration is formed in a radial direction also at a position excluding the central portion of the first plate-shaped body. In this case, it is preferable that a distance between the antinode of vibration formed at the position excluding the central portion of the first plate-shaped body and the plurality of second hole portions, in a direction orthogonal to the axis, be greater than a distance between the antinode of vibration formed at the position excluding the central portion of the first plate-shaped body and the plurality of first hole portions, and it is preferable that a distance between the antinode of vibration formed at the position excluding the central portion of the first plate-shaped body and the plurality of third hole portions, in the direction orthogonal to the axis, be greater than the distance between the antinode of vibration formed at the position excluding the central portion of the first plate-shaped body and the plurality of first hole portions.

In the first aspect, it is more preferable that each of the plurality of first hole portions be arranged in a region that overlaps with the antinode of vibration formed at the position excluding the central portion of the first plate-shaped body. Furthermore, it is more preferable that each of the plurality of second hole portions be arranged in a region that overlaps with the node of vibration formed in the first plate-shaped body when viewed along the extending direction of the axis, and it is more preferable that each of the plurality of third hole portions be arranged in a region that overlaps with the node of vibration formed in the first plate-shaped body when viewed along the extending direction of the axis.

In the second aspect, each of the plurality of second hole portions be arranged in the first peripheral wall portion, and each of the plurality of third hole portions be arranged in the second peripheral wall portion.

In the first aspect and the second aspect, the driving body may cause, such that an antinode of vibration is formed in a central portion of the second plate-shaped body, the second plate-shaped body to undergo bending vibration such that a standing wave is generated in the second plate-shaped body with the axis as a center, and may cause, such that an antinode of vibration is formed in a central portion of the third plate-shaped body, the third plate-shaped body to undergo bending vibration such that a standing wave is generated in the third plate-shaped body with the axis as a center.

In the third aspect, the driving body causes, such that an antinode of vibration is formed in a central portion of the second plate-shaped body, the second plate-shaped body to undergo bending vibration such that a standing wave is generated in the second plate-shaped body with the axis as a center, and causes, such that an antinode of vibration is formed in a central portion of the third plate-shaped body, the third plate-shaped body to undergo bending vibration such that a standing wave is generated in the third plate-shaped body with the axis as a center. Furthermore, the second plate-shaped body is caused to undergo bending vibration by the driving body such that an antinode of vibration is formed also at a position excluding the central portion of the second plate-shaped body. Furthermore, the third plate-shaped body is caused to undergo bending vibration by the driving body such that an antinode of vibration is formed also at a position excluding the central portion of the third plate-shaped body. In this case, it is preferable that each of the plurality of second hole portions be arranged in a region, of the second plate-shaped body, in an outer side portion relative to an antinode of vibration formed at a position farthest from the central portion of the second plate-shaped body, and it is preferable that each of the plurality of third hole portions be arranged in a region, of the third plate-shaped body, in an outer side portion relative to an antinode of vibration formed at a position farthest from the central portion of the third plate-shaped body.

In the pump according to the present disclosure, it is preferable that a hole other than the first hole portion, the second hole portion, and the third hole portion be not provided in any of the first plate-shaped body, the second plate-shaped body, the third plate-shaped body, the first peripheral wall portion, and the second peripheral wall portion.

In the pump according to the present disclosure, the driving body may include a piezoelectric element having a substantially flat plate shape, and in that case, it is preferable that the piezoelectric element be affixed to the central portion of the first plate-shaped body.

In the pump according to the present disclosure, it is preferable that each of the plurality of first hole portions be arranged in an outer side portion relative to the piezoelectric element, when viewed along the extending direction of the axis.

A fluid control device according to the present disclosure has a configuration in which the pump according to the present disclosure described above is mounted.

According to the present disclosure, in a displacement type pump using bending vibration of a vibration plate and a fluid control device including the same, a flow rate can be increased as compared with the existing technique.

Figure 1:
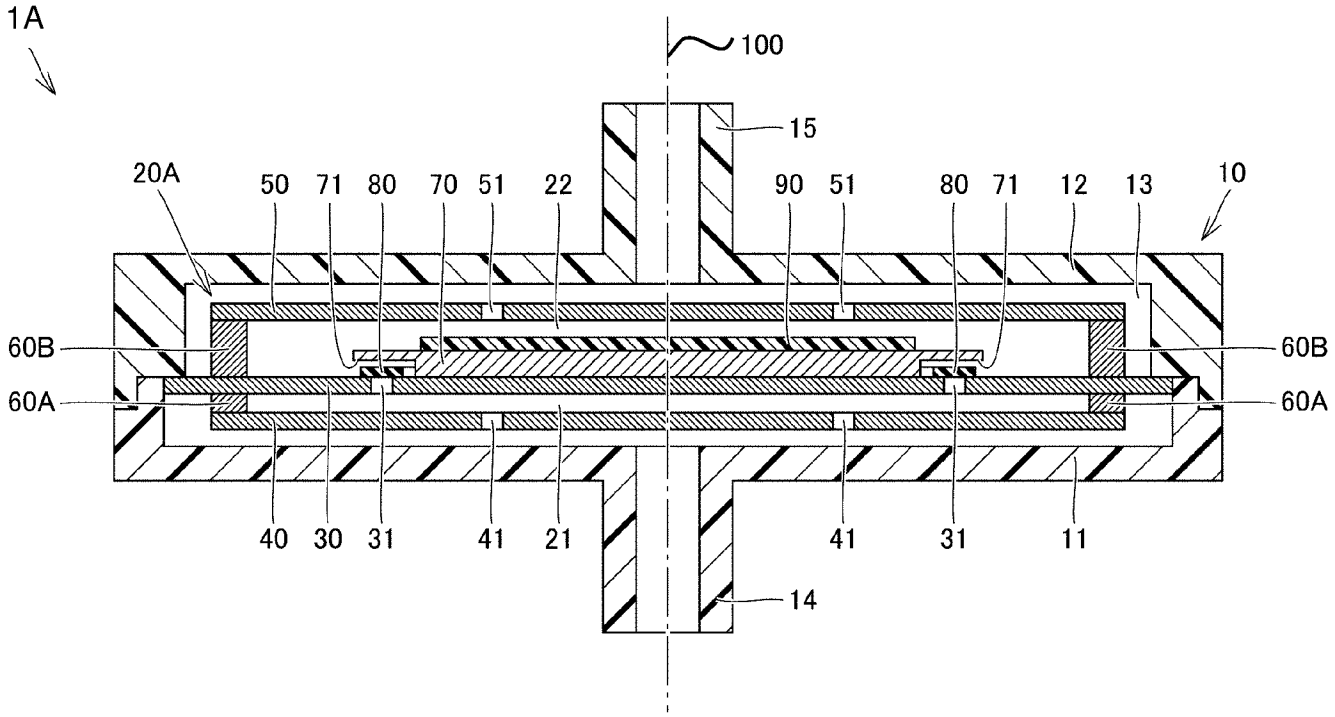
FIG. 1 is a schematic cross-sectional view of a piezoelectric blower according to a first embodiment.
Figure 3A:
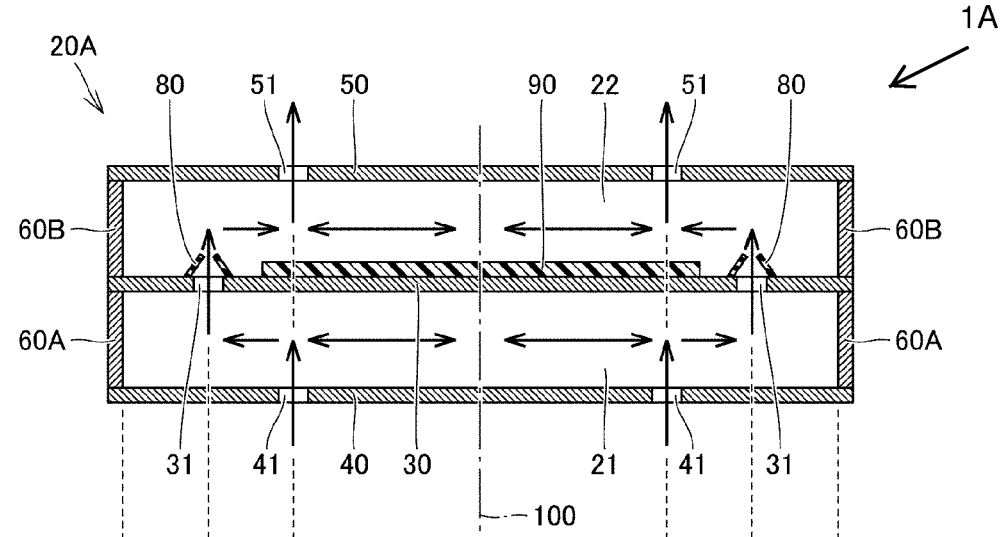
Figure 3B:
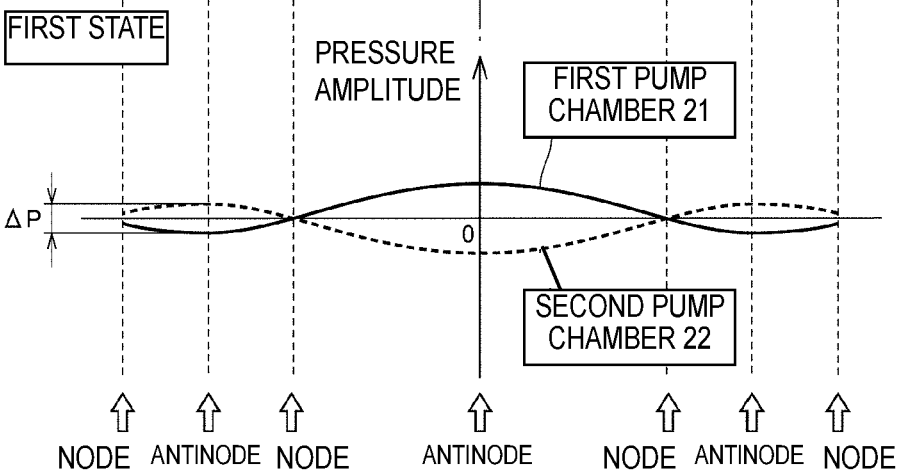
Figure 3C:
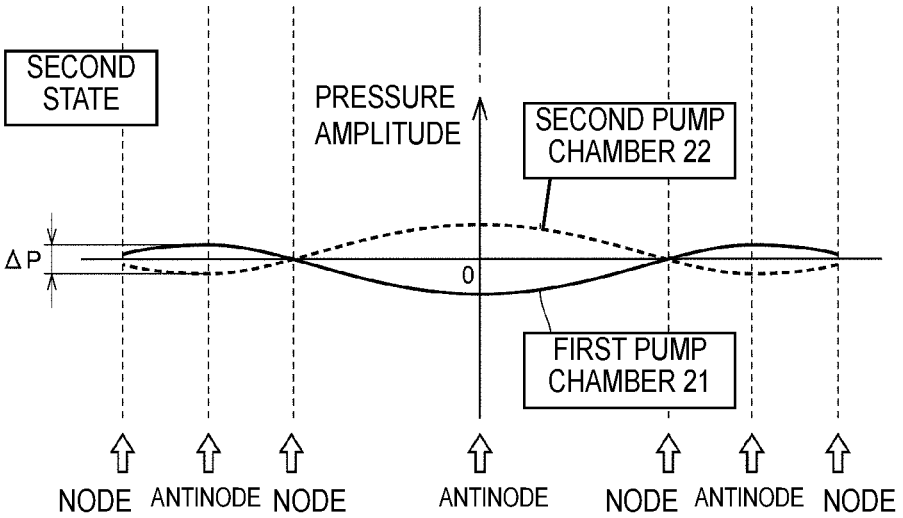

Each of FIGS. 3A, 3B and 3C is a schematic view illustrating a configuration and a rough direction of an airflow generated during operation of a driving unit of the piezoelectric blower illustrated in FIG. 1, and pressure fluctuations occurring in a first pump chamber and a second pump chamber.

Figure 4A:
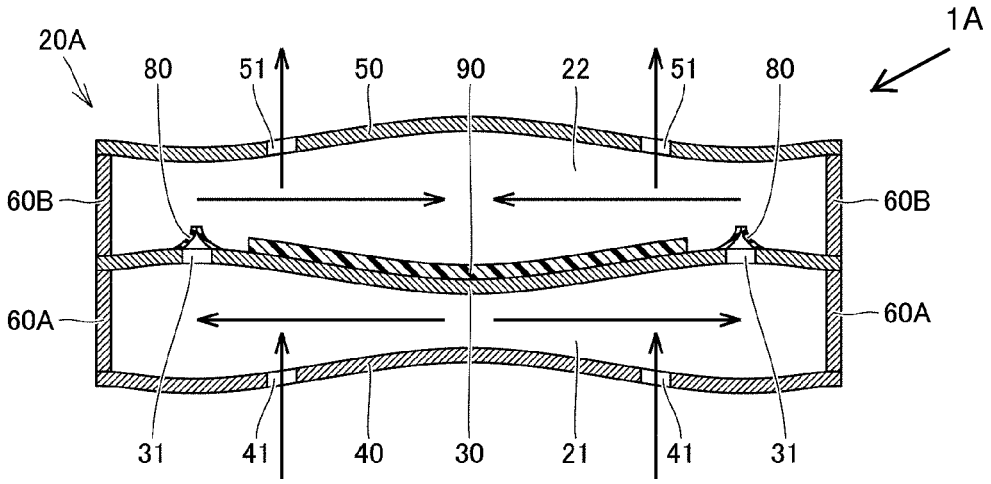
Figure 4B:
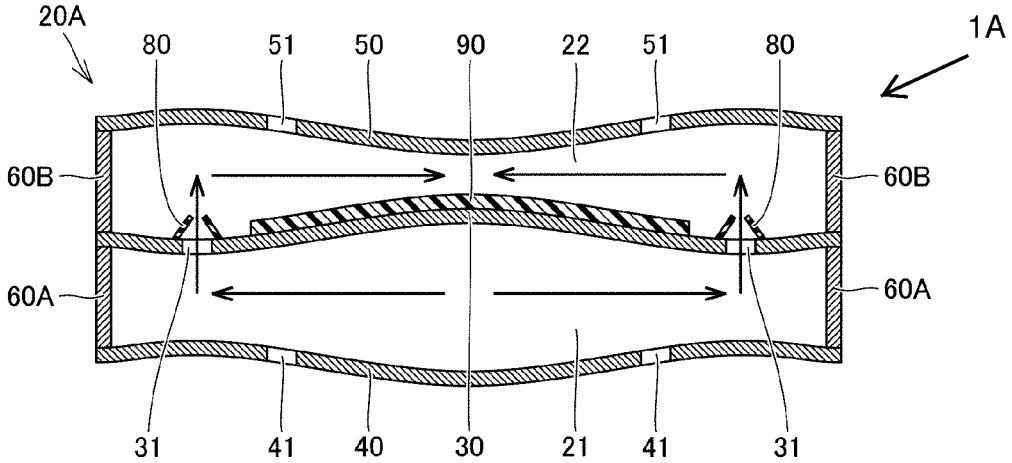

Each of FIGS. 4A and 4B is a schematic view illustrating with time an operation state of the driving unit of the piezoelectric blower illustrated in FIG. 1 and a direction of an airflow generated in the state.

Figure 5:
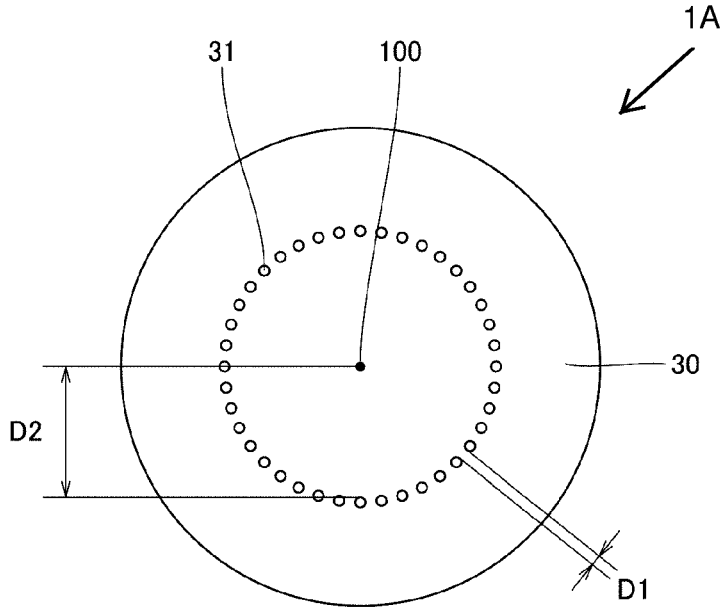

FIG. 5 is a plan view of a first vibration plate illustrated in FIG. 1.

Figure 6:
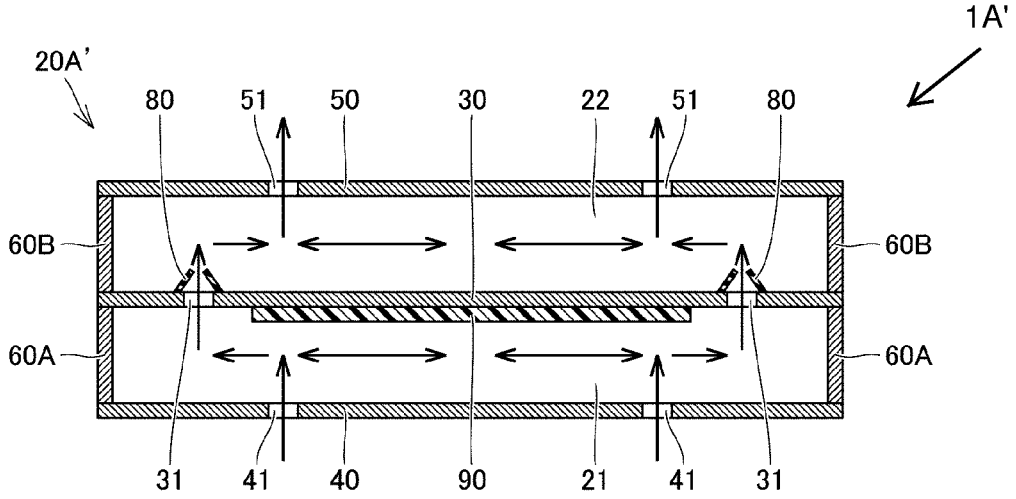

FIG. 6 is a schematic view illustrating a configuration and a rough direction of an airflow generated during operation of the driving unit of the piezoelectric blower according to a modification.

Figure 7A:
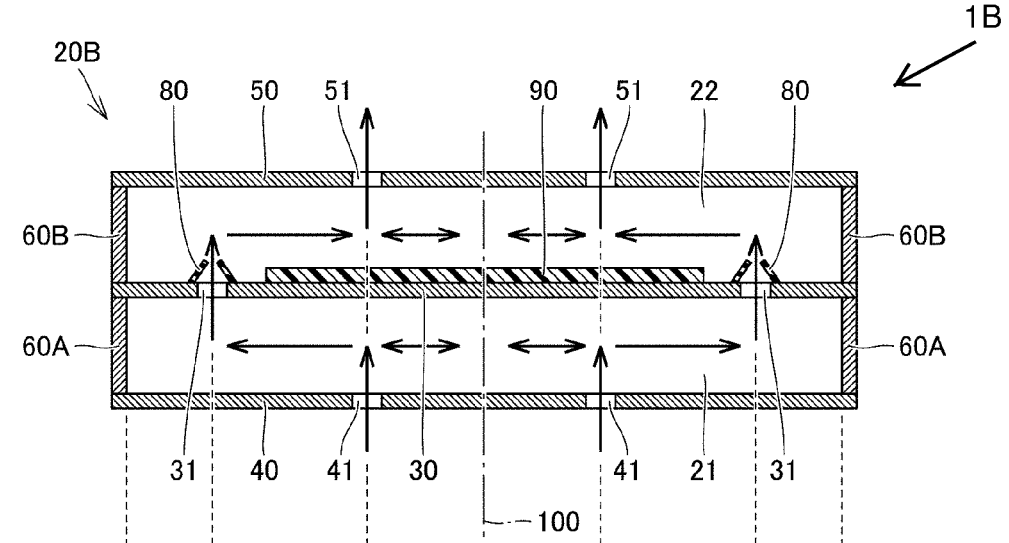
Figure 7B:
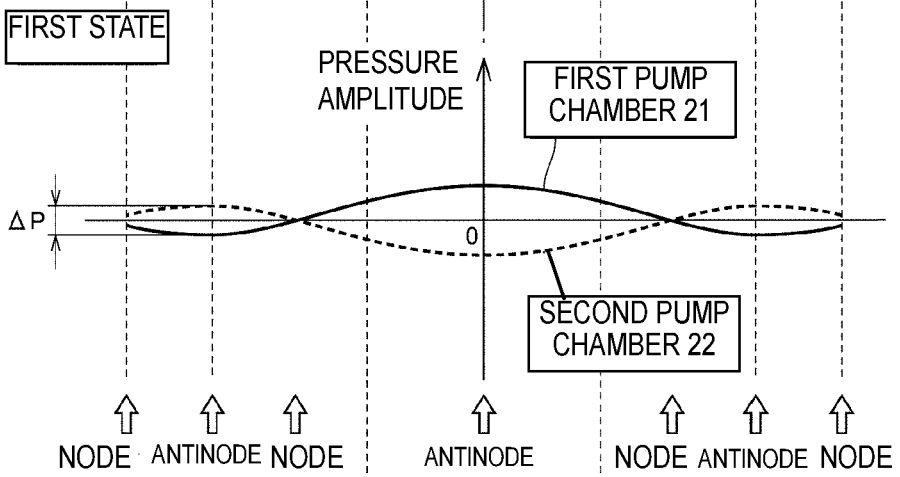
Figure 7C:
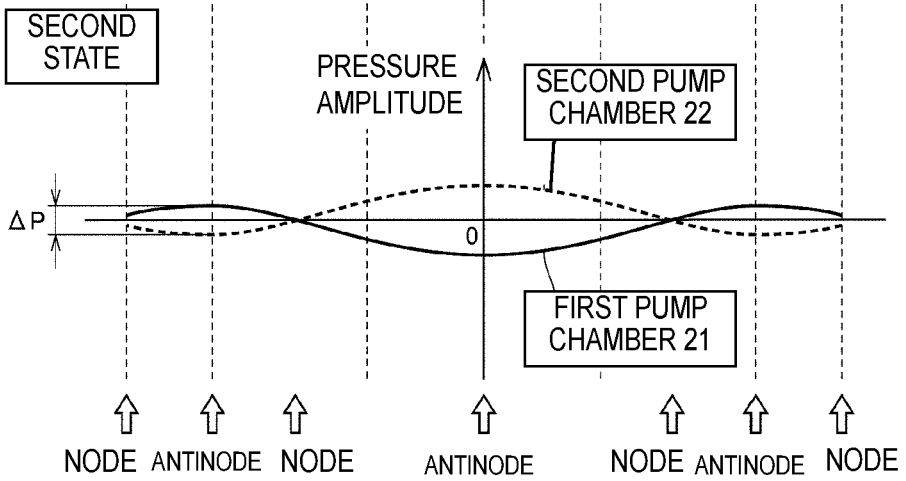

Each of FIGS. 7A, 7B and 7C is a schematic view illustrating a configuration and a rough direction of an airflow generated during operation of a driving unit of a piezoelectric blower according to a second embodiment, and pressure fluctuations occurring in a first pump chamber and a second pump chamber.

Figure 8A:
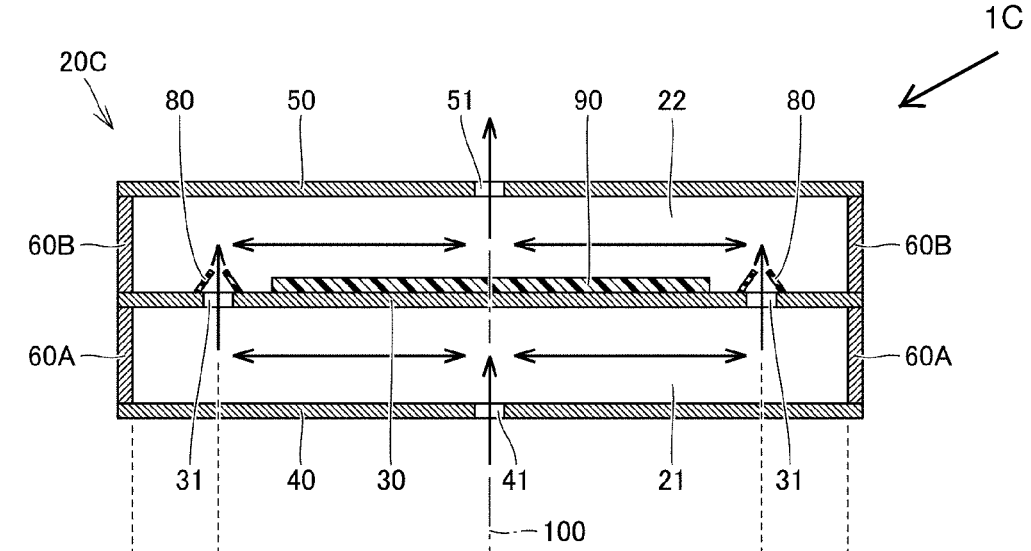
Figure 8B:
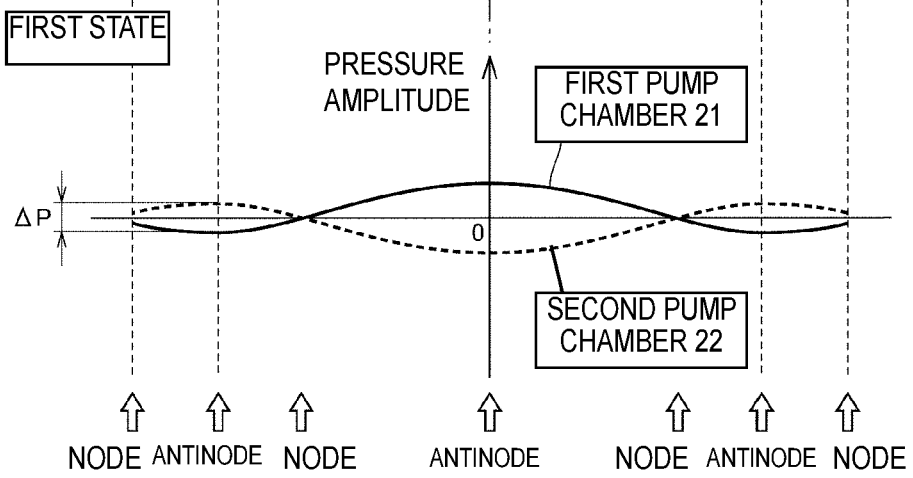
Figure 8C:
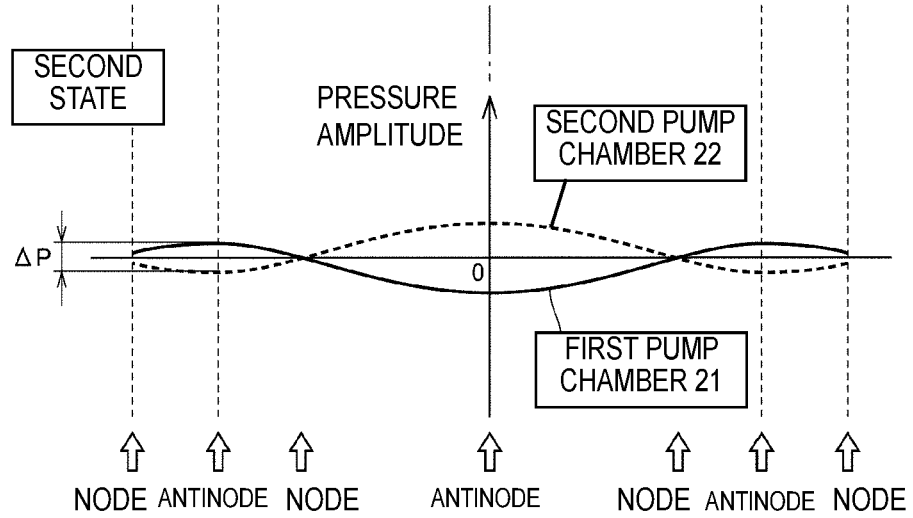

Each of FIGS. 8A, 8B and 8C is a schematic view illustrating a configuration and a rough direction of an airflow generated during operation of a driving unit of a piezoelectric blower according to a third embodiment, and pressure fluctuations occurring in a first pump chamber and a second pump chamber.

Figure 9A:
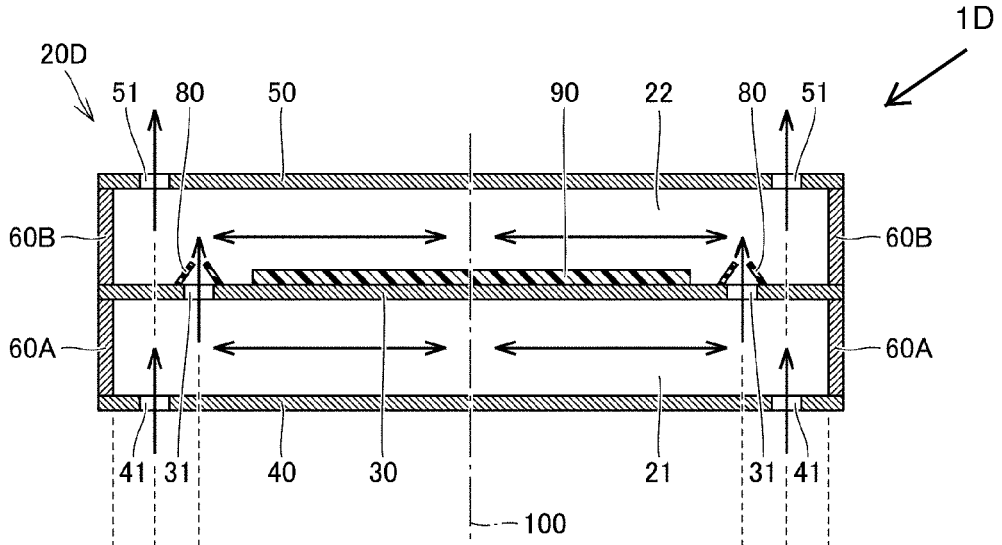
Figure 9B:
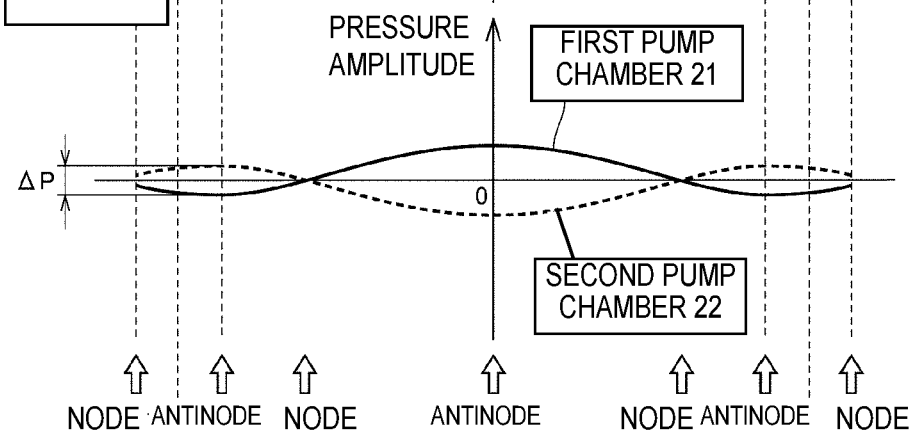
Figure 9C:
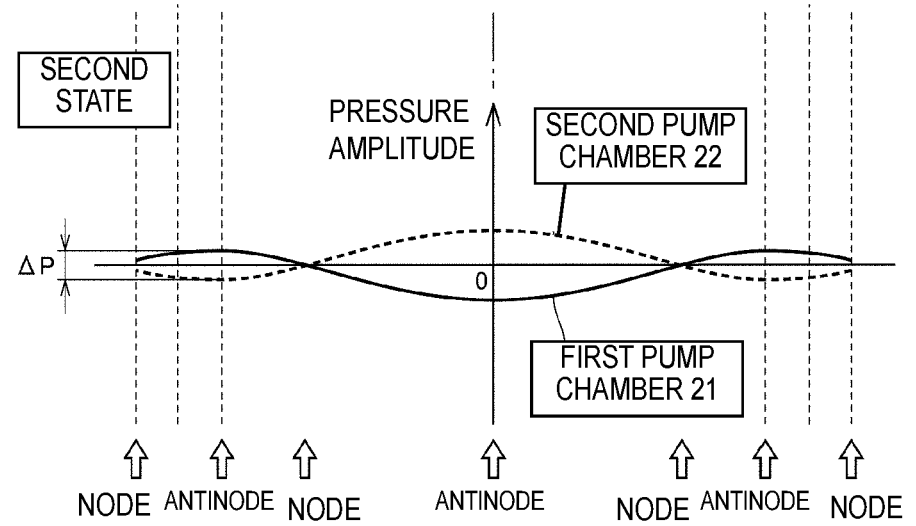

Each of FIGS. 9A, 9B and 9C is a schematic view illustrating a configuration and a rough direction of an airflow generated during operation of a driving unit of a piezoelectric blower according to a fourth embodiment, and pressure fluctuations occurring in a first pump chamber and a second pump chamber.

Figures 10A, 10B, 10C:
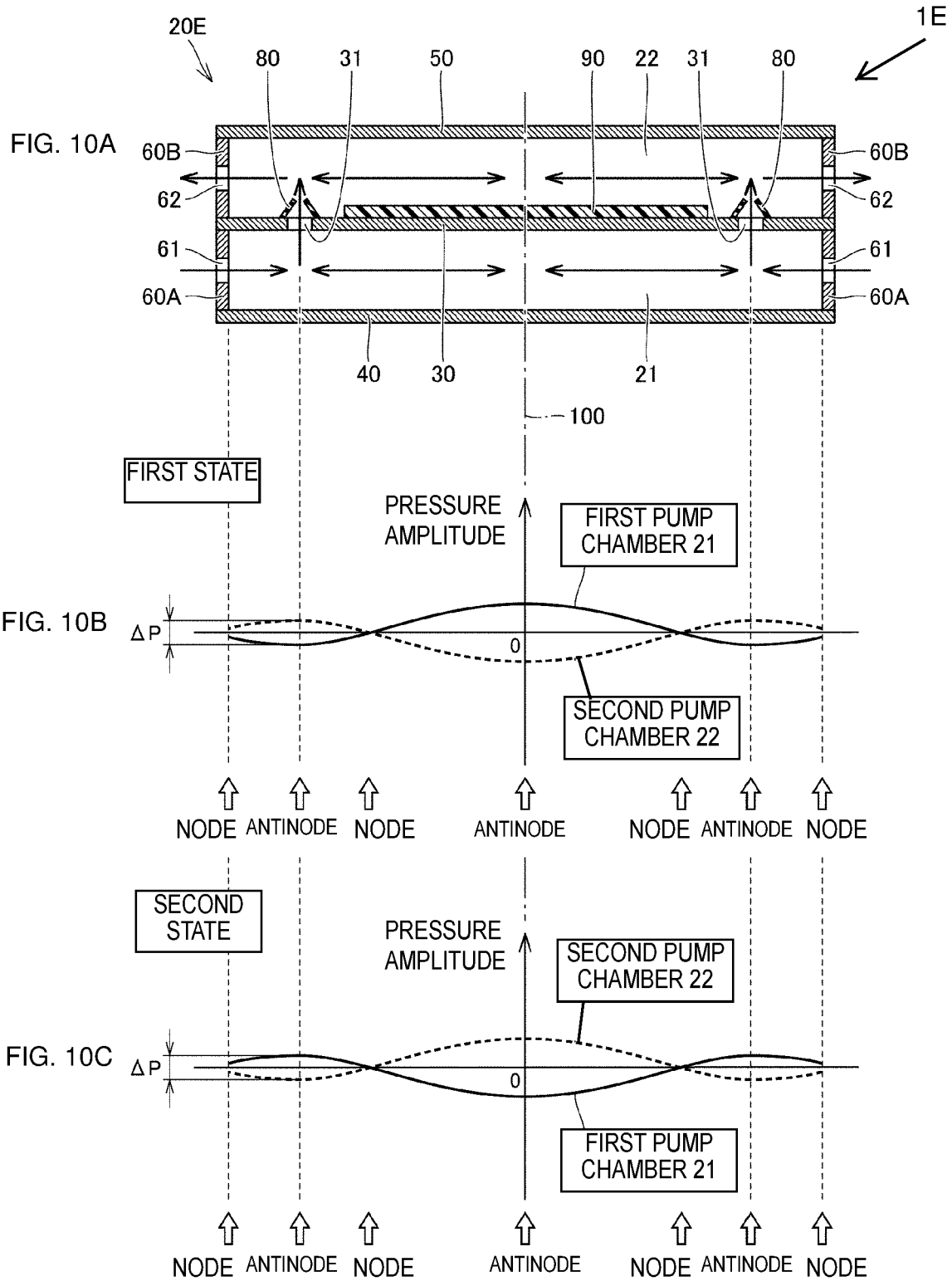

FIGS. 10A, 10B and 10C is a schematic view illustrating a configuration and a rough direction of an airflow generated during operation of a driving unit of a piezoelectric blower according to a fifth embodiment, and pressure fluctuations occurring in a first pump chamber and a second pump chamber.

Figure 11A:
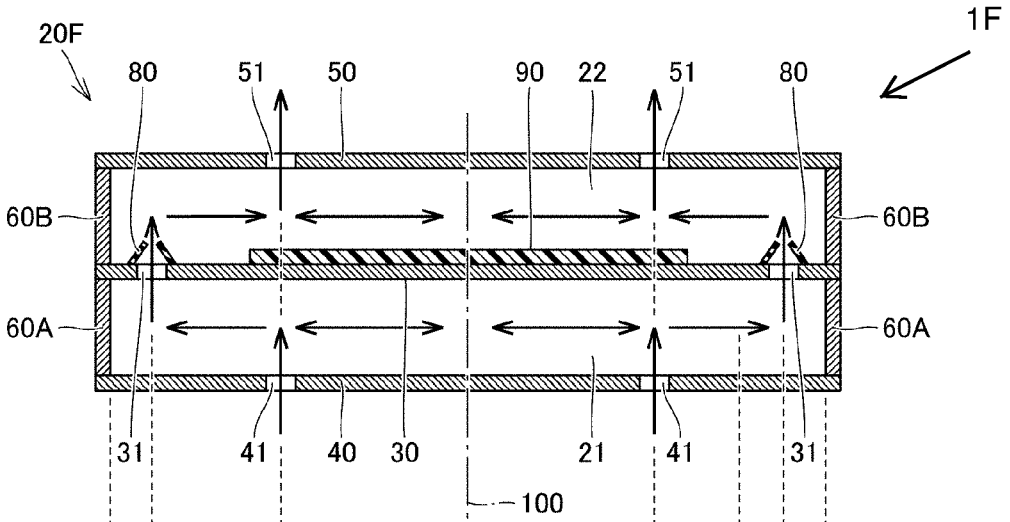
Figure 11B:
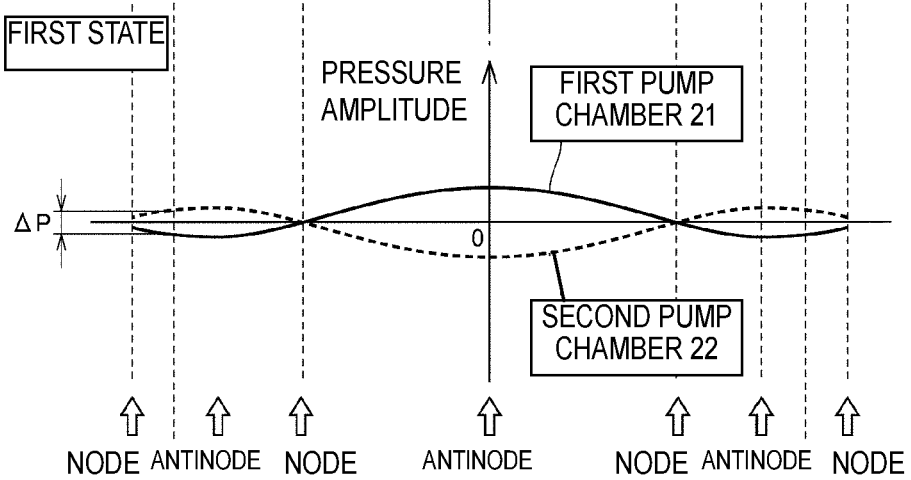
Figure 11C:
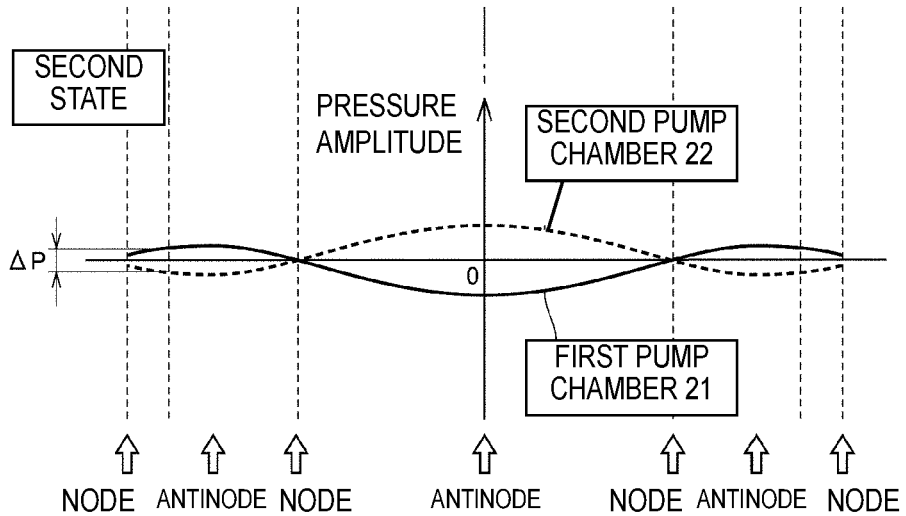

Each of FIGS. 11A, 11B and 11C is a schematic view illustrating a configuration and a rough direction of an airflow generated during operation of a driving unit of a piezoelectric blower according to a sixth embodiment, and pressure fluctuations occurring in a first pump chamber and a second pump chamber.

DETAILED DESCRIPTION OF THE DISCLOSURE

Hereinafter, embodiments of the present disclosure will be described in detail with reference to the drawings. The embodiments indicated below describes a case, as an example, in which the present disclosure is applied to a piezoelectric blower as a pump for sucking and discharging gas. Note that in the following embodiments, identical reference numerals are assigned to identical or common parts in the drawings, and the descriptions thereof will not be repeated.

First Embodiment

Figure 2:
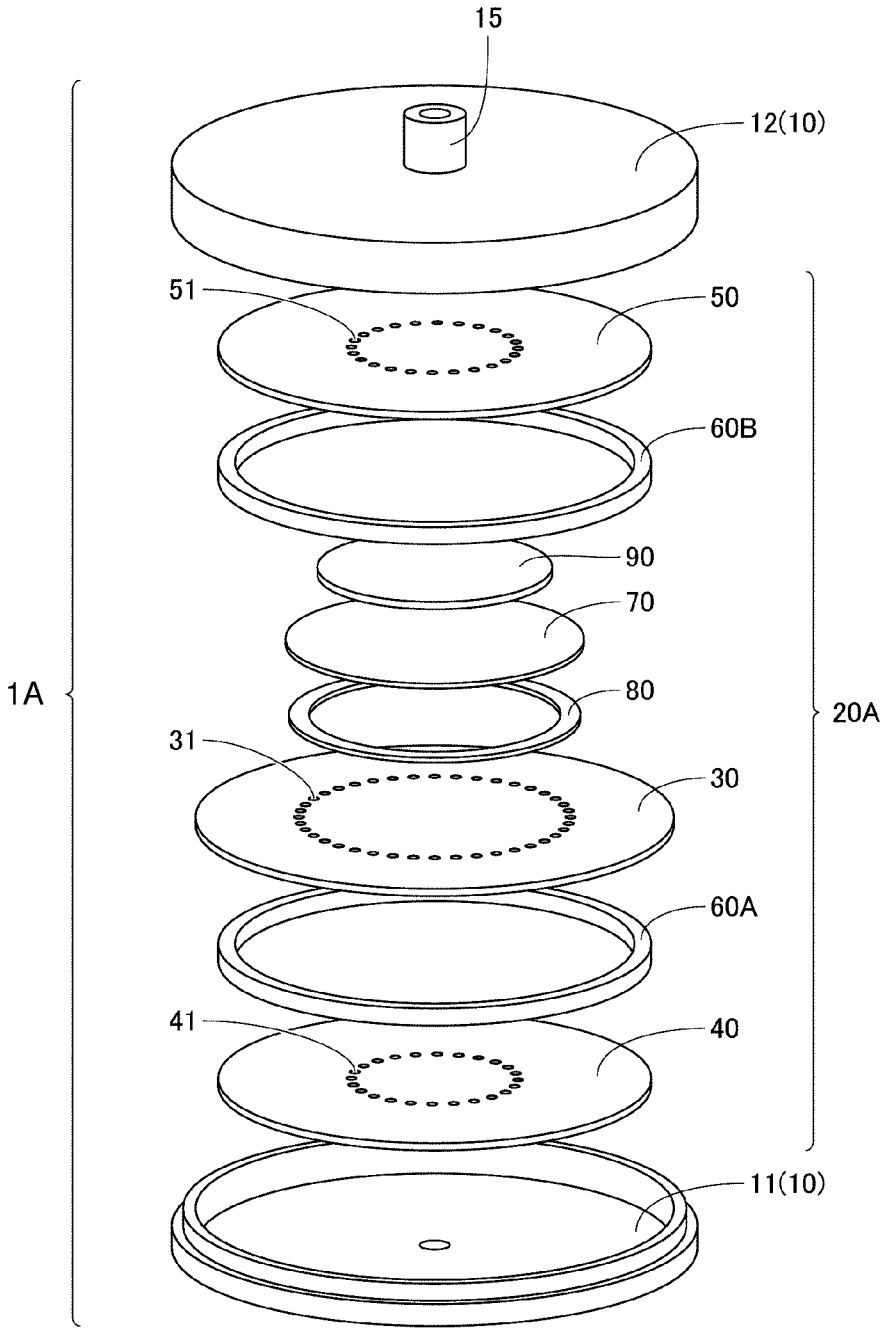
FIG. 2 is an exploded perspective view of the piezoelectric blower illustrated in FIG. 1.

FIG. 1 is a schematic cross-sectional view of a piezoelectric blower according to a first embodiment of the present disclosure, and FIG. 2 is an exploded perspective view of the piezoelectric blower illustrated in FIG. 1. First, the configuration of a piezoelectric blower 1A according to the present embodiment will be described with reference to FIG. 1 and FIG. 2.

As illustrated in FIG. 1 and FIG. 2, the piezoelectric blower 1A according to the present embodiment mainly includes a housing 10 and a driving unit 20A. Inside the housing 10, an accommodation space 13, which is a flat circular column-shaped space, is provided, and the driving unit 20A is arranged in the accommodation space 13.

The housing 10 includes a first case body 11 made of resin, metal, or the like and having a disk shape, and a second case body 12 made of resin or made of metal and having a flat bottomed cylindrical shape. The housing 10 has the accommodation space 13 described above in the inside thereof by the first case body 11 and the second case body 12 being combined and bonded by, for example, an adhesive or the like.

At the central portion of the first case body 11 and the central portion of the second case body 12, a first nozzle portion 14 and a second nozzle portion 15 each protruding toward an outer side portion are provided, respectively. The space outside the piezoelectric blower 1A and the above-described accommodation space 13 communicate with each other through each of the first nozzle portion 14 and the second nozzle portion 15.

The driving unit 20A mainly includes a first vibration plate 30 as a first plate-shaped body, a second vibration plate 40 as a second plate-shaped body, a third vibration plate 50 as a third plate-shaped body, a first spacer 60A as a first peripheral wall portion, a second spacer 60B as a second peripheral wall portion, a valve body holding member 70, a check valve 80, and a piezoelectric element 90 as a driving body. The driving unit 20A is configured by integrating these members together in a mutually stacked state, and is held by the housing 10 in a state of being arranged in the accommodation space 13 of the housing 10 described above. Here, the accommodation space 13 of the housing 10 is defined by the driving unit 20A, into a space on the first nozzle portion 14 side and a space on the second nozzle portion 15 side.

The first vibration plate 30 is constituted of a metal thin plate made of, for example, stainless steel or the like, and has a circular outer shape in a plan view. An outer end of the peripheral edge portion of the first vibration plate 30 is bonded to the housing 10 by, for example, an adhesive or the like. In the intermediate portion of the first vibration plate 30 excluding the central portion and the peripheral edge portion, a plurality of first hole portions 31 is annularly provided in a point sequence manner.

The second vibration plate 40 faces the first vibration plate 30, and more specifically, is arranged on a side where the first case body 11 is located when viewed from the first vibration plate 30. The second vibration plate 40 is constituted of a metal thin plate made of, for example, stainless steel or the like, and has a circular outer shape in a plan view. In the intermediate portion of the second vibration plate 40 excluding the central portion and the peripheral edge portion, a plurality of second hole portions 41 is annularly provided in a point sequence manner.

The third vibration plate 50 faces the first vibration plate 30, and more specifically, is arranged on a side where the second case body 12 is located when viewed from the first vibration plate 30 (that is, an opposite side to the side where the second vibration plate 40 is located when viewed from the first vibration plate 30). The third vibration plate 50 is constituted of a metal thin plate made of, for example, stainless steel or the like, and has a circular outer shape in a plan view. In the intermediate portion of the third vibration plate 50 excluding the central portion and the peripheral edge portion, a plurality of third hole portions 51 is annularly provided in a point sequence manner.

The first spacer 60A is located between the first vibration plate 30 and the second vibration plate 40, and is sandwiched between the first vibration plate 30 and the second vibration plate 40. The first spacer 60A is constituted of a metal member made of, for example, stainless steel or the like, and has an outer shape of an annular plate shape.

The first spacer 60A connects the peripheral edge portion at a portion of the first vibration plate 30 excluding the above-described outer end and the peripheral edge portion of the second vibration plate 40 to each other. With this, the first vibration plate 30 and the second vibration plate 40 are arranged at a predetermined distance from each other by the first spacer 60A. Note that the first spacer 60A and the first vibration plate 30 are bonded to each other by, for example, an adhesive or the like, and the first spacer 60A and the second vibration plate 40 are bonded to each other by, for example, an adhesive or the like.

A space located between the first vibration plate 30 and the second vibration plate 40 functions as a first pump chamber 21. The first pump chamber 21 is defined by the first vibration plate 30, the second vibration plate 40, and the first spacer 60A, and is constituted of a flat circular column-shaped space. Here, the first spacer 60A corresponds to a peripheral wall portion that defines the first pump chamber 21 and connects the first vibration plate 30 and the second vibration plate 40 to each other.

The second spacer 60B is located between the first vibration plate 30 and the third vibration plate 50, and is sandwiched between the first vibration plate 30 and the third vibration plate 50. The second spacer 60B is constituted of a metal member made of, for example, stainless steel or the like, and has an outer shape of an annular plate shape.

The second spacer 60B connects the peripheral edge portion at a portion of the first vibration plate 30 excluding the above-described outer end and the peripheral edge portion of the third vibration plate 50 to each other. With this, the first vibration plate 30 and the third vibration plate 50 are arranged at a predetermined distance from each other by the second spacer 60B. Note that the second spacer 60B and the first vibration plate 30 are bonded to each other by, for example, an adhesive or the like, and the second spacer 60B and the third vibration plate 50 are bonded to each other by, for example, an adhesive or the like.

A space located between the first vibration plate 30 and the third vibration plate 50 functions as a second pump chamber 22. The second pump chamber 22 is defined by the first vibration plate 30, the third vibration plate 50, and the second spacer 60B, and is constituted of a flat circular column-shaped space. Here, the second spacer 60B corresponds to a peripheral wall portion that defines the second pump chamber 22 and connects the first vibration plate 30 and the third vibration plate 50 to each other.

The valve body holding member 70 is affixed to the central portion of the first vibration plate 30 by, for example, an adhesive or the like, and more specifically, is arranged on the side where the third vibration plate 50 is located when viewed from the first vibration plate 30. The valve body holding member 70 is constituted of a metal thin plate made of, for example, stainless steel or the like, and has a circular outer shape in a plan view. The valve body holding member 70 has an annular step portion 71 that recedes toward a direction away from the first vibration plate 30 in a peripheral edge portion of a main surface located on the first vibration plate 30 side, and the annular step portion 71 faces the plurality of first hole portions 31 provided in the first vibration plate 30.

The check valve 80 is constituted of, for example, a resin member such as a polyimide resin or the like, and has an outer shape of an annular plate shape. The check valve 80 is accommodated in the annular step portion 71 by being loosely fitted to the annular step portion 71 of the valve body holding member 70. That is, the check valve 80 is located between the annular step portion 71 of the valve body holding member 70 and the first vibration plate 30 at the portion facing the annular step portion 71.

With this, the check valve 80 is movably held by the valve body holding member 70 so as to be able to open/close the plurality of first hole portions 31 provided in the first vibration plate 30. More specifically, the check valve 80 closes the plurality of first hole portions 31 in a state of making close contact with the first vibration plate 30 by approaching, and opens the plurality of first hole portions 31 in a state of being away from the first vibration plate 30.

The piezoelectric element 90 is, by being affixed to the valve body holding member 70 with, for example, an adhesive interposed therebetween, affixed to the central portion of the first vibration plate 30 with the valve body holding member 70 interposed therebetween. With this, the piezoelectric element 90 is affixed to the main surface side of the first vibration plate 30 located on the side facing the second pump chamber 22. The piezoelectric element 90 is constituted of a thin plate made of a piezoelectric material such as lead zirconate titanate (PZT) or the like, for example, and has a circular outer shape in a plan view.

The piezoelectric element 90 generates bending vibration by application of an AC voltage, the bending vibration generated in the piezoelectric element 90 propagates in the first vibration plate 30, the second vibration plate 40, and the third vibration plate 50, whereby the first vibration plate 30, the second vibration plate 40, and the third vibration plate 50 are also caused to undergo bending vibration. That is, the piezoelectric element 90 corresponds to a driving body that causes the first vibration plate 30, the second vibration plate 40, and the third vibration plate 50 to undergo bending vibration, causes, by an AC voltage having a predetermined frequency being applied thereto, each of the first vibration plate 30, the second vibration plate 40, and the third vibration plate 50 to vibrate at a resonant frequency, thereby generating standing waves in each of the first vibration plate 30, the second vibration plate 40, and the third vibration plate.

Here, the piezoelectric element 90 is not necessarily required to have a circular shape in a plan view, and may have a regular polygonal shape in a plan view. When the piezoelectric element 90 has a circular shape or a regular polygonal shape in a plan view, it is preferable that the first vibration plate 30 and the piezoelectric element 90 be arranged such that the center of the first vibration plate 30 and the center of the piezoelectric element 90 coincide with each other. By configuring in this manner, it is possible to more reliably and easily generate the standing wave in the first vibration plate 30.

By having the configuration described above, in the piezoelectric blower 1A according to the present embodiment, the first pump chamber 21 and the second pump chamber 22 are located between the first nozzle portion 14 and the second nozzle portion 15, a space on the first nozzle portion 14 side relative to the position where the first pump chamber 21 is provided and the first pump chamber 21, of the accommodation space 13 of the housing 10, are in a state of always communicating with each other by the plurality of second hole portions 41 provided in the second vibration plate 40, a space on the second nozzle portion 15 side relative to the position where the second pump chamber 22 is provided and the second pump chamber 22, of the accommodation space 13 of the housing 10, are in a state of always communicating with each other by the plurality of third hole portions 51 provided in the third vibration plate 50, and furthermore, in a state where the plurality of first hole portions 31 provided in the first vibration plate 30 is not closed by the check valve 80, the first pump chamber 21 and the second pump chamber 22 are in a state of communicating with each other by the plurality of first hole portions 31.

Here, in the piezoelectric blower 1A according to the present embodiment, the piezoelectric element 90 causes the first vibration plate 30, the second vibration plate 40, and the third vibration plate 50 to undergo bending vibration so as to generate standing waves in each of the first vibration plate 30, the second vibration plate 40, and the third vibration plate 50 with an axis 100 orthogonal to the central portion of the first vibration plate 30, the central portion of the second vibration plate 40, and the central portion of the third vibration plate 50 as the center. More specifically, the piezoelectric element 90 causes the first vibration plate 30, the second vibration plate 40, and the third vibration plate 50 to undergo bending vibration such that an antinode of vibration is formed in each of the central portion of the first vibration plate 30, the central portion of the second vibration plate 40, and the central portion of the third vibration plate 50, and an antinode of vibration is formed also in a position excluding the central portion of the first vibration plate 30, a position excluding the central portion of the second vibration plate 40, and a position excluding the central portion of the third vibration plate 50. Note that in the piezoelectric blower 1A according to the present embodiment, the first vibration plate 30, the second vibration plate 40, and the third vibration plate 50 are driven such that one antinode of vibration is formed in the radial direction at the position excluding the central portion of each of the vibration plates.

In this case, the piezoelectric element 90 directly drives the first vibration plate 30 to which the piezoelectric element 90 is affixed, and indirectly drives the second vibration plate 40 and the third vibration plate 50 to each of which the piezoelectric element 90 is not affixed with the first spacer 60A as the first peripheral wall portion and the second spacer 60B as the second peripheral wall portion interposed therebetween, respectively. At this time, by appropriately designing the shape of the first vibration plate 30 and the shape of the second vibration plate 40 (in particular, the thicknesses of these vibration plates), the first vibration plate 30 and the second vibration plate 40 are respectively displaced in the reverse directions. In the same manner, by appropriately designing the shape of the first vibration plate 30 and the shape of the third vibration plate 50 (in particular, the thicknesses of these vibration plates), the first vibration plate 30 and the third vibration plate 50 are respectively displaced in the reverse directions.

The first pump chamber 21 repeats expansion and contraction due to the vibrations of the first vibration plate 30 and the second vibration plate 40 in the reverse directions, and the second pump chamber 22 repeats expansion and contraction due to the vibrations of the first vibration plate 30 and the third vibration plate 50 in the reverse directions. Accordingly, resonance occurs in each of the inside of the first pump chamber 21 and the inside of the second pump chamber 22, and in accordance with this, a large pressure fluctuation occurs in each of the first pump chamber 21 and the second pump chamber 22. As a result, positive pressure and negative pressure are alternately generated in the first pump chamber 21 and the second pump chamber 22 in time, and a pump function for sending gas with pressure is obtained by this pressure fluctuation.

Each of FIGS. 3A, 3B and 3C is a schematic view illustrating a configuration and a rough direction of an airflow generated during operation of the driving unit of the piezoelectric blower illustrated in FIG. 1, and pressure fluctuations occurring in the first pump chamber and the second pump chamber, and Each of FIGS. 4A and 4B is a schematic view illustrating with time an operation state of the driving unit of the piezoelectric blower illustrated in FIG. 1 and a direction of an airflow generated in the state. Next, the operation state of the piezoelectric blower 1A according to the present embodiment will be described with reference to FIGS. 3A, 3B and 3C, and FIGS. 4A and 4B.

Referring to FIGS. 3A, 3B and 3C, in the piezoelectric blower 1A according to the present embodiment, as described above, the check valve 80 is attached to each of the plurality of first hole portions 31 provided in the first vibration plate 30, whereas the check valve is not attached to each of the plurality of second hole portions 41 provided in the second vibration plate 40 and the plurality of third hole portions 51 provided in the third vibration plate 50.

Here, the check valve 80 provided on each of the plurality of first hole portions 31 is configured to allow gas to flow from the first pump chamber 21 toward the second pump chamber 22, but not to allow gas to flow in the reverse direction thereof. Therefore, due to the action of the check valve 80, the direction of the airflow generated during the operation of the piezoelectric blower 1A is determined, and the rough directions of the airflow are the directions indicated by the arrows in FIG. 3A.

Specifically, as illustrated in FIG. 4A, in a state in which the central portion of the first vibration plate 30 and the central portion of the second vibration plate 40 are displaced in a direction approaching each other and the central portion of the first vibration plate 30 and the central portion of the third vibration plate 50 are displaced in a direction away from each other, negative pressure is generated in the first pump chamber 21 at portions located in the vicinity of the plurality of first hole portions 31, and positive pressure is generated in the second pump chamber 22 at portions located in the vicinity of the plurality of first hole portions 31, and thus the check valves 80 close the plurality of first hole portions 31, respectively. At this time, since the volume of the first pump chamber 21 increases as a whole and the volume of the second pump chamber 22 decreases as a whole, gas is sucked into the first pump chamber 21 through the plurality of second hole portions 41 provided in the second vibration plate 40, and gas is discharged from the second pump chamber 22 through the plurality of third hole portions 51 provided in the third vibration plate 50.

Thereafter, as illustrated in FIG. 4B, in a state in which the central portion of the first vibration plate 30 and the central portion of the second vibration plate 40 are displaced in a direction away from each other and the central portion of the first vibration plate 30 and the central portion of the third vibration plate 50 are displaced in a direction approaching each other, positive pressure is generated in the first pump chamber 21 at the portions located in the vicinity of the plurality of first hole portions 31, and negative pressure is generated in the second pump chamber 22 at the portions located in the vicinity of the plurality of first hole portions 31, and thus the check valves 80 open the plurality of first hole portions 31, respectively. Therefore, gas moves from the first pump chamber 21 to the second pump chamber 22 through the plurality of first hole portions 31.

By the first vibration plate 30, the second vibration plate 40, and the third vibration plate 50 vibrating such that the state illustrated in FIG. 4A and the state illustrated in FIG. 4B are alternately repeated, the airflow having the direction illustrated in FIG. 3A is generated in the piezoelectric blower 1A. Therefore, the first nozzle portion 14 provided in the housing 10 functions as a suction nozzle for sucking gas from the outside, the second nozzle portion 15 provided in the housing 10 functions as a discharge nozzle for discharging gas to the outside, and thus the gas is sent with pressure by the piezoelectric blower 1A.

Note that FIG. 3B schematically illustrates pressure distribution of each of the first pump chamber 21 and the second pump chamber 22 in the above-described state illustrated in FIG. 4A (hereinafter, this state is referred to as a first state), and FIG. 3C schematically illustrates pressure distribution of each of the first pump chamber 21 and the second pump chamber 22 in the above-described state illustrated in FIG. 4B (hereinafter, this state is referred to as a second state).

As is apparent from FIG. 3B and FIG. 3C, in the piezoelectric blower 1A according to the present embodiment, by driving the first vibration plate 30, the second vibration plate 40, and the third vibration plate 50 under the above-described condition where resonance occurs in each of the first pump chamber 21 and the second pump chamber 22, an antinode of a pressure fluctuation inside the first pump chamber 21 is generated at the central portion of the first pump chamber 21, a node of the pressure fluctuation inside the first pump chamber 21 is generated at a position in an outer side portion relative thereto, an antinode of the pressure fluctuation inside the first pump chamber 21 is generated at a position in a further outer side portion relative thereto, and a node of the pressure fluctuation inside the first pump chamber 21 is generated at the outer edge portion of the first pump chamber 21, and an antinode of a pressure fluctuation inside the second pump chamber 22 is generated at the central portion of the second pump chamber 22, a node of the pressure fluctuation inside the second pump chamber 22 is generated at a position in an outer side portion relative thereto, an antinode of the pressure fluctuation inside the second pump chamber 22 is generated at a position in a further outer side portion relative thereto, and a node of the pressure fluctuation inside the second pump chamber 22 is generated at the outer edge portion of the second pump chamber 22.

Here, in the piezoelectric blower 1A according to the present embodiment, referring to FIG. 3A, the plurality of first hole portions 31 provided in the first vibration plate 30, the plurality of second hole portions 41 provided in the second vibration plate 40, and the plurality of third hole portions 51 provided in the third vibration plate 50 satisfy the following conditions.

The first vibration plate 30 is provided with the plurality of first hole portions 31, when viewed along the extending direction of the axis 100, in a region that does not overlap with the axis 100 and that does not overlap with the node of vibration formed in the first vibration plate 30, and the check valves 80 are respectively attached to the plurality of first hole portions 31. More specifically, the plurality of first hole portions 31 is provided in a region that overlaps with the antinode of vibration formed at a position excluding the central portion of the first vibration plate 30. Furthermore, the plurality of first hole portions 31 is arranged, in a point sequence shape, at positions on a circumference with the axis 100 as the center, when viewed along the extending direction of the axis 100.

The second vibration plate 40 is provided with the plurality of second hole portions 41, when viewed along the extending direction of the axis 100, in a region that does not overlap with each of the plurality of first hole portions 31 and that overlaps with the node of vibration formed in the second vibration plate 40 (in other words, each of the plurality of second hole portions 41 is provided in a region that overlaps with the node of vibration formed in the first vibration plate 30 when viewed along the extending direction of the axis 100), the check valve is not attached to the plurality of second hole portions 41. Furthermore, the plurality of second hole portions 41 is arranged, in a point sequence shape, at positions on a circumference with the axis 100 as the center, when viewed along the extending direction of the axis 100.

The third vibration plate 50 is provided with the plurality of third hole portions 51, when viewed along the extending direction of the axis 100, in a region that does not overlap with each of the plurality of first hole portions 31 and that overlaps with the node of vibration formed in the third vibration plate 50 (in other words, each of the plurality of third hole portions 51 is provided in a region that overlaps with the node of vibration formed in the first vibration plate 30 when viewed along the extending direction of the axis 100), the check valve is not attached to the plurality of third hole portions 51. Furthermore, the plurality of third hole portions 51 is arranged, in a point sequence shape, at positions on a circumference with the axis 100 as the center, when viewed along the extending direction of the axis 100.

Note that the first vibration plate 30, the second vibration plate 40, the third vibration plate 50, the first spacer 60A, and the second spacer 60B that define the first pump chamber 21 and the second pump chamber 22 are not provided with holes other than the plurality of first hole portions 31, the plurality of second hole portions 41, and the plurality of third hole portions 51 described above.

By configuring in this manner, in the piezoelectric blower 1A according to the present embodiment, it is possible to increase the flow rate as compared with the existing technique. The reason for this will be described in detail below.

In the piezoelectric blower 1A according to the present embodiment, the check valves 80 that determine the direction of the airflow in the piezoelectric blower 1A are respectively attached to the plurality of first hole portions 31 provided in the intermediate portion of the first vibration plate 30 excluding the central portion and the peripheral edge portion. By configuring in this manner, in comparison with a case where a configuration is employed in which the hole portion to which the check valve is attached is provided in the central portion of the first vibration plate, flow path resistance for gas moving from the first pump chamber 21 to the second pump chamber 22 is largely reduced, and the flow rate in the portion can thus be increased.

However, as described above, since a displacement amount at the intermediate portion of the vibration plate excluding the central portion and the peripheral edge portion is smaller than that in the central portion of the vibration plate, the opening/closing itself of the check valve is likely to be insufficient only by employing the above-described configuration.

Therefore, in order to solve this problem, in the piezoelectric blower 1A according to the present embodiment, by arranging a pair of the second vibration plate 40 and the third vibration plate 50 so as to face the first vibration plate 30 provided with the plurality of first hole portions 31 to which the check valves 80 that determine the direction of the airflow in the piezoelectric blower 1A are respectively attached, the first vibration plate 30 is configured so as to be sandwiched between the first pump chamber 21 and the second pump chamber 22, whereby the opening/closing of the check valve 80 is surely performed by using a differential pressure between positive pressure and negative pressure that are generated in the first pump chamber 21 and the second pump chamber 22.

In other words, as illustrated in FIG. 3B, in the first state, since the negative pressure is generated in the first pump chamber 21 in the portions located in the vicinity of the plurality of first hole portions 31, and the positive pressure is generated in the second pump chamber 22 in the portions located in the vicinity of the plurality of first hole portions 31, a state where the check valve 80 is closed is more surely obtained by the differential pressure $\Delta P$ thereof, and as illustrated in FIG. 3C, in the second state, since the positive pressure is generated in the first pump chamber 21 in the portions located in the vicinity of the plurality of first hole portions 31, and the negative pressure is generated in the second pump chamber 22 in the portions located in the vicinity of the plurality of first hole portions 31, a state where the check valve 80 is opened is more surely obtained by the differential pressure $\Delta P$ thereof.

Here, in the piezoelectric blower 1A according to the present embodiment, as described above, since the plurality of first hole portions 31 is provided so as to overlap with the antinode of vibration formed at positions of the first vibration plate 30 excluding the central portion of the first vibration plate 30, a larger differential pressure $\Delta P$ between the first pump chamber 21 and the second pump chamber 22 described above can be secured, and the opening/closing of the check valve 80 can be more surely performed in this respect.

Accordingly, using the piezoelectric blower 1A according to the present embodiment makes it possible to surely perform the opening/closing operation of the check valve 80 while reducing the flow path resistance in the driving unit 20A, and as a result, it is possible to increase the flow rate as compared with the existing technique.

Note that, in the piezoelectric blower 1A according to the present embodiment, as described above, since the configuration is such that the check valve is not attached to any of the plurality of second hole portions 41 provided in the second vibration plate 40 and the plurality of third hole portions 51 provided in the third vibration plate 50, the flow path resistance is not increased in the portions, and thus the flow rate is increased in this respect as well.

Furthermore, in the piezoelectric blower 1A according to the present embodiment, as described above, the plurality of second hole portions 41 provided in the second vibration plate 40 is arranged so as not to overlap with the antinode of vibration formed in the second vibration plate 40, and the plurality of third hole portions 51 provided in the third vibration plate 50 is arranged so as not to overlap with the antinode of vibration formed in the third vibration plate 50. In other words, in the piezoelectric blower 1A according to the present embodiment, each of the plurality of second hole portions 41 and each of the plurality of third hole portions 51 are arranged so as not to overlap with each of the plurality of first hole portions 31 when viewed along the extending direction of the axis 100. Accordingly, it is possible to largely suppress the gas from flowing back in the plurality of second hole portions 41 and the plurality of third hole portions 51, and the flow rate is increased in this respect as well.

In this regard, in the piezoelectric blower 1A according to the present embodiment, a distance, in the direction orthogonal to the axis 100, between the antinode of vibration formed at the position excluding the central portion of the first vibration plate 30 and the plurality of second hole portions 41 is configured to be larger than a distance between the antinode of vibration formed at the position excluding the central portion of the first vibration plate 30 and the plurality of first hole portions 31, and a distance, in the direction orthogonal to the axis 100, between the antinode of vibration formed at the position excluding the central portion of the first vibration plate 30 and the plurality of third hole portions 51 is configured to be larger than a distance between the antinode of vibration formed at the position excluding the central portion of the first vibration plate 30 and the plurality of first hole portions 31. As long as the condition is satisfied, it is possible to secure a large differential pressure ΔP between the first pump chamber 21 and the second pump chamber 22 described above, it is also possible to suppress the gas from flowing back in the plurality of second hole portions 41 and the plurality of third hole portions 51, and the flow rate can be increased as a result.

Furthermore, in the piezoelectric blower 1A according to the present embodiment, as described above, since the plurality of second hole portions 41 provided in the second vibration plate 40 and the plurality of third hole portions 51 provided in the third vibration plate 50 are each annularly arranged in a point sequence manner, the axial symmetry of the airflow in the piezoelectric blower 1A is improved, turbulence is less likely to occur in the airflow and efficient flow of the gas can be obtained, and the flow rate can be increased as a result.

FIG. 5 is a plan view of the first vibration plate illustrated in FIG. 1. Hereinafter, with reference to FIG. 5, a configuration more preferable for increasing the flow rate in the piezoelectric blower 1A according to the present embodiment will be described.

As illustrated in FIG. 5, in the piezoelectric blower 1A according to the present embodiment, as described above, in the intermediate portion of the first vibration plate 30 excluding the central portion and the peripheral edge portion, the plurality of first hole portions 31 is annularly provided in a point sequence manner. By configuring in this manner, as described above, the flow path resistance at the plurality of first hole portions 31 provided in the first vibration plate 30 is reduced, and it is thus possible to increase the flow rate.

Here, it is preferable that the plurality of first hole portions 31 be constituted of a plurality of circular column-shaped holes having the same opening diameter, arranged at equal intervals to each other. By configuring in this manner, since the axial symmetry of the airflow in the piezoelectric blower 1A is improved, turbulence is less likely to occur in the airflow, efficient flow of the gas can be obtained, and the flow rate can be increased as a result.

Furthermore, it is preferable that a distance D1 between adjacent first hole portions of the plurality of first hole portions 31 be smaller than a distance D2 between the axis 100 and each of the plurality of first hole portions 31. This is because, although the gas located in the vicinity of the plurality of first hole portions 31 in the first pump chamber 21 is partially moved toward the central portion of the first pump chamber 21 in accordance with the pressure fluctuation of the first pump chamber 21 and is returned to the original position by being reflected at the central portion, by employing the above-described configuration, most of the gas located in the vicinity of the plurality of first hole portions 31 preferentially flows into the plurality of first hole portions 31, whereby a rate of the gas moving toward the central portion of the first pump chamber 21 can be reduced, and as a result, it is possible to increase the flow rate of the piezoelectric blower 1A as a whole.

Furthermore, in the piezoelectric blower 1A according to the present embodiment, the plurality of first hole portions 31 annularly arranged in a point sequence manner is all located in an outer side portion of the piezoelectric element 90 when viewed along the extending direction of the axis 100. In the case of employing the configuration as described above, the first pump chamber 21 and the second pump chamber 22 can be easily communicated with each other without providing a through-hole or the like in the piezoelectric element 90. Here, the case where the piezoelectric element 90 is provided with a through-hole does not necessarily lead to an advantageous configuration in terms of manufacturing cost, reliability, and the like. On the other hand, by employing the configuration as described above, it is not necessary to provide a through-hole in the piezoelectric element 90, and it is thus possible to obtain a piezoelectric blower which is further reduced in cost and has excellent reliability.

Note that the dimensions of respective components of the piezoelectric blower 1A according to the present embodiment described above, the number of various kinds of holes provided in the first vibration plate 30, the second vibration plate 40, and the third vibration plate 50, and the like are not particularly limited, and examples thereof are as follows.

The diameter of the first vibration plate 30 is, for example, 25 [mm], and the diameter of the portion thereof defining the first pump chamber 21 and the second pump chamber 22 is, for example, 19 [mm]. The diameter of the second vibration plate 40 is, for example, 23 [mm], and the diameter of the portion thereof defining the first pump chamber 21 is, for example, 19 [mm]. The diameter of the third vibration plate 50 is, for example, 23 [mm], and the diameter of the portion thereof defining the second pump chamber 22 is, for example, 19 [mm]. The thickness of the first vibration plate 30 is, for example, 0.2 [mm], and the thicknesses of the second vibration plate 40 and the third vibration plate 50 are each 0.25 [mm], for example. Furthermore, the outer diameters and the inner diameters of each of the first spacer 60A and the second spacer 60B are, for example, 23 [mm] and 19 [mm], respectively, and the thicknesses thereof are each 0.3 [mm], for example.

The plurality of first hole portions 31 provided in the first vibration plate 30 is annularly arranged in a point sequence manner at positions each separated from the central portion of the first vibration plate 30 by, for example, 6 [mm], each opening diameter thereof is, for example, 0.4 [mm], and the number thereof is approximately 50. The plurality of second hole portions 41 provided in the second vibration plate 40 is annularly arranged in a point sequence manner at positions each separated from the central portion of the second vibration plate 40 by, for example, 4 [mm], each opening diameter thereof is, for example, 0.4 [mm], and the number thereof is approximately 40. The plurality of third hole portions 51 provided in the third vibration plate 50 is annularly arranged in a point sequence manner at positions each separated from the central portion of the third vibration plate 50 by, for example, 4 [mm], each opening diameter thereof is, for example, 0.4 [mm], and the number thereof is approximately 40.

(Modification)

FIG. 6 is a schematic view illustrating a configuration and a rough direction of an airflow generated during operation of the driving unit of the piezoelectric blower according to a modification of the first embodiment described above. Hereinafter, a piezoelectric blower 1A' according to the modification will be described with reference to FIG. 6.

As illustrated in FIG. 6, the piezoelectric blower 1A' according to the modification includes a driving unit 20A' having a configuration different from that of the piezoelectric blower 1A according to the first embodiment described above. In the same manner as the driving unit 20A of the piezoelectric blower 1A according to the first embodiment described above, the driving unit 20A' includes the first vibration plate 30, the second vibration plate 40, the third vibration plate 50, the first spacer 60A, the second spacer 60B, the check valve 80, the piezoelectric element 90, and the like, but is different in arrangement position and configuration of the piezoelectric element 90.

Specifically, in the piezoelectric blower 1A' according to the modification, the piezoelectric element 90 is affixed to the main surface of the first vibration plate 30 on the side facing the first pump chamber 21 with, for example, an adhesive interposed therebetween. That is, unlike the piezoelectric blower 1A according to the first embodiment described above, the piezoelectric element 90 is directly affixed to the first vibration plate 30 without interposing the valve body holding member 70.

In the case of employing this configuration as well, the same effect as the effect described in the first embodiment described above can be obtained, and the piezoelectric blower having an increased flow rate as compared with the existing technique can be obtained.

Second Embodiment

Each of FIGS. 7A, 7B and 7C is a schematic view illustrating a configuration and a rough direction of an airflow generated during operation of a driving unit of a piezoelectric blower according to a second embodiment of the present disclosure, and pressure fluctuations occurring in a first pump chamber and a second pump chamber. Hereinafter, a piezoelectric blower 1B according to the present embodiment will be described with reference to FIGS. 7A, 7B and 7C.

As illustrated in FIG. 7A, the piezoelectric blower 1B according to the present embodiment includes a driving unit 20B having a configuration different from that of the piezoelectric blower 1A according to the first embodiment described above. In the same manner as the driving unit 20A of the piezoelectric blower 1A according to the first embodiment described above, the driving unit 20B includes the first vibration plate 30, the second vibration plate 40, the third vibration plate 50, the first spacer 60A, the second spacer 60B, the check valve 80, the piezoelectric element 90, and the like, but is different in configuration of holes provided in the second vibration plate 40 and the third vibration plate 50.

Specifically, the second vibration plate 40 is provided with the plurality of second hole portions 41 in a region in an outer side portion relative to the central portion of the second vibration plate 40 and in an inner side portion relative to a node of vibration in the most inner side portion among nodes of vibration formed in the second vibration plate 40. The plurality of second hole portions 41 is arranged, in a point sequence shape, at positions on a circumference with the axis 100 as the center, when viewed along the extending direction of the axis 100.

Furthermore, the third vibration plate 50 is provided with the plurality of third hole portions 51 in a region in an outer side portion relative to the central portion of the third vibration plate 50 and in an inner side portion relative to a node of vibration in the most inner side portion among nodes of vibration formed in the third vibration plate 50. The plurality of third hole portions 51 is arranged, in a point sequence shape, at positions on a circumference with the axis 100 as the center, when viewed along the extending direction of the axis 100.

In the case of employing the configuration as well, the pressure fluctuations of the first pump chamber 21 and the second pump chamber 22 as illustrated in FIG. 7B and FIG. 7C can be obtained in the first state and the second state, respectively, and the airflow as illustrated in FIG. 7A is generated in the piezoelectric blower 1B on the basis thereof.

Here, the region of the second vibration plate 40 where the plurality of second hole portions 41 is provided and the region of the third vibration plate 50 where the plurality of third hole portions 51 is provided are respectively portions in each of which a larger displacement is generated during driving than the node of vibration formed in the second vibration plate 40 and the node of vibration formed in the third vibration plate 50, but in the case of employing the configuration as described above as well, the effect equivalent to the effect described in the first embodiment described above can be obtained, and the piezoelectric blower having an increased flow rate as compared with the existing technique can thus be obtained.

Third Embodiment

Each of FIGS. 8A, 8B and 8C is a schematic view illustrating a configuration and a rough direction of an airflow generated during operation of a driving unit of a piezoelectric blower according to a third embodiment of the present disclosure, and pressure fluctuations occurring in a first pump chamber and a second pump chamber. Hereinafter, a piezoelectric blower 1C according to the present embodiment will be described with reference to FIGS. 8A, 8B and 8C.

As illustrated in FIG. 8A, the piezoelectric blower 1C according to the present embodiment includes a driving unit 20C having a configuration different from that of the piezoelectric blower 1A according to the first embodiment described above. In the same manner as the driving unit 20A of the piezoelectric blower 1A according to the first embodiment described above, the driving unit 20C includes the first vibration plate 30, the second vibration plate 40, the third vibration plate 50, the first spacer 60A, the second spacer 60B, the check valve 80, the piezoelectric element 90, and the like, but is different in configuration of holes provided in the second vibration plate 40 and the third vibration plate 50.

Specifically, the second vibration plate 40 is provided with one second hole portion 41 in a region overlapping with the axis 100 when viewed along the extending direction of the axis 100, and the third vibration plate 50 is provided with one third hole portion 51 in a region overlapping with the axis 100 when viewed along the extending direction of the axis 100.

In the case of employing the configuration as well, the pressure fluctuations of the first pump chamber 21 and the second pump chamber 22 as illustrated in FIG. 8B and FIG. 8C can be obtained in the first state and the second state, respectively, and the airflow as illustrated in FIG. 8A is generated in the piezoelectric blower 1C on the basis thereof.

Here, the region of the second vibration plate 40 where the one second hole portion 41 is provided and the region of the third vibration plate 50 where the one third hole portion 51 is provided are respectively portions in each of which a larger displacement is generated during driving than the node of vibration formed in the second vibration plate 40 and the node of vibration formed in the third vibration plate 50, but in the case of employing the configuration as described above as well, the effect equivalent to the effect described in the first embodiment described above can be obtained, and the piezoelectric blower having an increased flow rate as compared with the existing technique can thus be obtained.

Fourth Embodiment

Each of FIGS. 9A, 9B and 9C is a schematic view illustrating a configuration and a rough direction of an airflow generated during operation of a driving unit of a piezoelectric blower according to a fourth embodiment of the present disclosure, and pressure fluctuations occurring in a first pump chamber and a second pump chamber. Hereinafter, a piezoelectric blower 1D according to the present embodiment will be described with reference to FIGS. 9A, 9B and 9C.

As illustrated in FIG. 9A, the piezoelectric blower 1D according to the present embodiment includes a driving unit 20D having a configuration different from that of the piezoelectric blower 1A according to the first embodiment described above. In the same manner as the driving unit 20A of the piezoelectric blower 1A according to the first embodiment described above, the driving unit 20D includes the first vibration plate 30, the second vibration plate 40, the third vibration plate 50, the first spacer 60A, the second spacer 60B, the check valve 80, the piezoelectric element 90, and the like, but is different in configuration of holes provided in the second vibration plate 40 and the third vibration plate 50.

Specifically, the second vibration plate 40 is provided with the plurality of second hole portions 41 in a region in an outer side portion relative to an antinode of vibration in the most outer side portion among antinodes of vibration formed in the second vibration plate 40 and in an inner side portion relative to the peripheral edge portion of the second vibration plate. The plurality of second hole portions 41 is arranged, in a point sequence shape, at positions on a circumference with the axis 100 as the center, when viewed along the extending direction of the axis 100.

Furthermore, the third vibration plate 50 is provided with the plurality of third hole portions 51 in a region in an outer side portion relative to an antinode of vibration in the most outer side portion among antinodes of vibration formed in the third vibration plate 50 and in an inner side portion relative to the peripheral edge portion of the third vibration plate. The plurality of third hole portions 51 is arranged, in a point sequence shape, at positions on a circumference with the axis 100 as the center, when viewed along the extending direction of the axis 100.

In the case of employing the configuration as well, the pressure fluctuations of the first pump chamber 21 and the second pump chamber 22 as illustrated in FIG. 9B and FIG. 9C can be obtained in the first state and the second state, respectively, and the airflow as illustrated in FIG. 9A is generated in the piezoelectric blower 1D on the basis thereof.

Here, the region of the second vibration plate 40 where the plurality of second hole portions 41 is provided and the region of the third vibration plate 50 where the plurality of third hole portions 51 is provided are respectively portions in each of which a larger displacement is generated during driving than the node of vibration formed in the second vibration plate 40 and the node of vibration formed in the third vibration plate 50, but in the case of employing the configuration as described above as well, the effect equivalent to the effect described in the first embodiment described above can be obtained, and the piezoelectric blower having an increased flow rate as compared with the existing technique can thus be obtained.

Fifth Embodiment

Each of FIGS. 10A, 10B and 10C is a schematic view illustrating a configuration and a rough direction of an airflow generated during operation of a driving unit of a piezoelectric blower according to a fifth embodiment of the present disclosure, and pressure fluctuations occurring in a first pump chamber and a second pump chamber. Hereinafter, a piezoelectric blower 1E according to the present embodiment will be described with reference to FIGS. 10A, 10B and 10C.

As illustrated in FIG. 10A, the piezoelectric blower 1E according to the present embodiment includes a driving unit 20E having a configuration different from that of the piezoelectric blower 1A according to the first embodiment described above. In the same manner as the driving unit 20A of the piezoelectric blower 1A according to the first embodiment described above, the driving unit 20E includes the first vibration plate 30, the second vibration plate 40, the third vibration plate 50, the first spacer 60A, the second spacer 60B, the check valve 80, the piezoelectric element 90, and the like, but is different in configuration of holes.

Specifically, no hole is provided in the second vibration plate 40, and a plurality of second hole portions 61 is provided in the first spacer 60A as the first peripheral wall portion instead. The plurality of second hole portions 61 is arranged, in a point sequence shape, at positions on a circumference with the axis 100 as the center, when viewed along the extending direction of the axis 100.

Furthermore, no hole is provided in the third vibration plate 50, and a plurality of third hole portions 62 is provided in the second spacer 60B as the second peripheral wall portion instead. The plurality of third hole portions 62 is arranged, in a point sequence shape, at positions on a circumference with the axis 100 as the center, when viewed along the extending direction of the axis 100.

In the case of employing the configuration as well, the pressure fluctuations of the first pump chamber 21 and the second pump chamber 22 as illustrated in FIG. 10B and FIG. 10C can be obtained in the first state and the second state, respectively, and the airflow as illustrated in FIG. 10A is generated in the piezoelectric blower 1E on the basis thereof.

Here, since the first spacer 60A provided with the plurality of second hole portions 61 and the second spacer 60B provided with the plurality of third hole portions 62 are respectively portions in each of which a large displacement is not basically generated even in a state where the piezoelectric element 90 is driven, in the case of employing the configuration as described above as well, the effect equivalent to the effect described in the first embodiment described above can be obtained, and the piezoelectric blower having an increased flow rate as compared with the existing technique can thus be obtained.

Sixth Embodiment

Each of FIGS. 11A, 11B and 11C is a schematic view illustrating a configuration and a rough direction of an airflow generated during operation of a driving unit of a piezoelectric blower according to a sixth embodiment of the present disclosure, and pressure fluctuations occurring in a first pump chamber and a second pump chamber. Hereinafter, a piezoelectric blower 1F according to the present embodiment will be described with reference to FIGS. 11A, 11B and 11C.

As illustrated in FIG. 11A, the piezoelectric blower 1F according to the present embodiment includes a driving unit 20F having a configuration different from that of the piezoelectric blower 1A according to the first embodiment described above. In the same manner as the driving unit 20A of the piezoelectric blower 1A according to the first embodiment described above, the driving unit 20F includes the first vibration plate 30, the second vibration plate 40, the third vibration plate 50, the first spacer 60A, the second spacer 60B, the check valve 80, the piezoelectric element 90, and the like, but is different in configuration of holes provided in the first vibration plate 30.

Specifically, the first vibration plate 30 is provided with the plurality of first hole portions 31 in a region, which does not overlap with the axis 100 when viewed along the extending direction of the axis 100, in an outer side portion relative to an antinode of vibration formed at a position excluding the central portion of the first vibration plate 30 and in an inner side portion relative to the peripheral edge portion of the first vibration plate 30. The plurality of first hole portions 31 is arranged, in a point sequence shape, at positions on a circumference with the axis 100 as the center, when viewed along the extending direction of the axis 100.

In the case of employing the configuration as well, the pressure fluctuations of the first pump chamber 21 and the second pump chamber 22 as illustrated in FIG. 11B and FIG. 11C can be obtained in the first state and the second state, respectively, and the airflow as illustrated in FIG. 11A is generated in the piezoelectric blower 1F on the basis thereof.

Here, the region of the first vibration plate 30 where the plurality of first hole portions 31 is provided is a portion in which a smaller displacement is generated during driving than the antinode of vibration formed in the first vibration plate 30, but in the case of employing the configuration as described above as well, the effect equivalent to the effect described in the first embodiment described above can be obtained, and the piezoelectric blower having an increased flow rate as compared with the existing technique can thus be obtained.

Note that, in a case where the plurality of first hole portions 31 is arranged in a region which does not overlap with the antinode of vibration formed in the first vibration plate 30, as in the present embodiment, it is preferable to arrange the plurality of first hole portions 31 in a region in an outer side portion relative to a node of vibration formed at a position farthest from the central portion of the first vibration plate 30 among nodes of vibration formed in the region excluding the peripheral edge portion of the first vibration plate 30. This is because, during driving, the volume fluctuations of the first pump chamber 21 and the second pump chamber 22 in the portions corresponding to the region respectively become larger as a whole than the volume fluctuations of the first pump chamber 21 and the second pump chamber 22 in the portions corresponding to the region in the inner side portion relative to the above-described node, and configuring as described above makes it possible to obtain a larger differential pressure.

(Others)

Although, in the first to sixth embodiments and the modification thereof of the present disclosure described above, the case where the plurality of first hole portions provided in the first plate-shaped body is annularly arranged in a point sequence manner has been described as an example, it is not absolutely necessary to annularly arrange them in a point sequence manner, and the layout thereof can be appropriately changed.

Furthermore, although, in the first, second, fourth to sixth embodiments and the modification thereof of the present disclosure described above, the case where the plurality of second hole portions provided in the second plate-shaped body and the plurality of third hole portions provided in the third plate-shaped body are both annularly arranged in a point sequence manner has been described as an example, it is not absolutely necessary to annularly arrange them in a point sequence manner, and the layout thereof can be appropriately changed.

Furthermore, although, in the first to sixth embodiments and the modification thereof of the present disclosure described above, the case where the piezoelectric element as the driving body is affixed to one main surface side of the first plate-shaped body has been described as an example, the configuration may be such that a pair of piezoelectric elements is provided, and the pair of piezoelectric elements are respectively affixed to both main surfaces of the first plate-shaped body. In that case, the displacement of the first plate-shaped body can be increased, and it is thus possible to further increase the flow rate.

Furthermore, although, in the first to sixth embodiments and the modification thereof of the present disclosure described above, the case where the piezoelectric element as the driving body is affixed to the first plate-shaped body has been described as an example, the piezoelectric element may be affixed to the second plate-shaped body or the third plate-shaped body, or both of them. In that case, it is possible to obtain an effect of facilitating routing of wiring to the piezoelectric element.

Furthermore, although, in the first to sixth embodiments and the modification thereof of the present disclosure described above, the case where the piezoelectric element causes the first plate-shaped body, the second plate-shaped body, and the third plate-shaped body to undergo bending vibration such that an antinode of vibration is formed in each of the central portion of the first plate-shaped body, the central portion of the second plate-shaped body, and the central portion of the third plate-shaped body, and one antinode of vibration is formed in the radial direction also in each of the position excluding the central portion of the first plate-shaped body, the position excluding the central portion of the second plate-shaped body, and the position excluding the central portion of the third plate-shaped body has been described as an example, the piezoelectric element may cause the first plate-shaped body, the second plate-shaped body, and the third plate-shaped body to undergo bending vibration such that the antinode is formed only in each of the central portion of the first plate-shaped body, the central portion of the second plate-shaped body, and the central portion of the third plate-shaped body. Furthermore, the piezoelectric element may cause the first plate-shaped body, the second plate-shaped body, and the third plate-shaped body to undergo bending vibration such that the antinode of vibration is formed in each of the central portion of the first plate-shaped body, the central portion of the second plate-shaped body, and the central portion of the third plate-shaped body, and two or more antinodes of vibration are formed in the radial direction also in each of the position excluding the central portion of the first plate-shaped body, the position excluding the central portion of the second plate-shaped body, and the position excluding the central portion of the third plate-shaped body.

Furthermore, although, in the first to sixth embodiments and the modification thereof of the present disclosure described above, the case where the configuration is such that not only the first plate-shaped body but also the second plate-shaped body and the third plate-shaped body are caused to undergo bending vibration has been described as an example, it is not absolutely necessary to cause the second plate-shaped body and the third plate-shaped body to undergo bending vibration, and the configuration may be such that only the first plate-shaped body is caused to undergo bending vibration.

Furthermore, the characteristic configurations described in the first to sixth embodiments and the modification thereof of the present disclosure described above can be appropriately combined without departing from the essential spirit of the present disclosure.

In addition, although, in the first to sixth embodiments and the modification thereof of the present disclosure described above, the case where the present disclosure is applied to the piezoelectric blower for sucking and discharging gas has been described as an example, the present disclosure can also be applied to a pump for sucking and discharging liquid and a pump using a component other than the piezoelectric element as the driving body (note that as a matter of course, it is limited to a displacement type pump using bending vibration of a vibration plate).

Note that in the first to sixth embodiments and the modification thereof of the present disclosure described above, although only the pump to which the present disclosure is applied has been described in detail among the pump and the fluid control device to which the present disclosure is applied, the fluid control device to which the present disclosure is applied is configured by the pump to which the present disclosure is applied being mounted thereon. That is, the fluid control device to which the present disclosure is applied is a fluid system including a pump to which the present disclosure is applied (for example, the piezoelectric blower according to the first to sixth embodiments and the modification thereof of the present disclosure described above) as a component, and is a device in which the pump and another fluid control component cooperate to control the behavior of the fluid in accordance with the application.

In this manner, the embodiments and modification disclosed herein are illustrative in all aspects and not restrictive. The technical scope of the present disclosure is defined by the scope of the appended claims, and is intended to include all modifications within the meaning and range equivalent to the scope of the claims.

1A TO 1F, 1A' PIEZOELECTRIC BLOWER
10 HOUSING
11 FIRST CASE BODY
12 SECOND CASE BODY
13 ACCOMMODATION SPACE
14 FIRST NOZZLE PORTION
15 SECOND NOZZLE PORTION
20A TO 20F, 20A' DRIVING UNIT
21 FIRST PUMP CHAMBER
222 SECOND PUMP CHAMBER
30 FIRST VIBRATION PLATE
31 FIRST HOLE PORTION
40 SECOND VIBRATION PLATE
41 SECOND HOLE PORTION
50 THIRD VIBRATION PLATE
51 THIRD HOLE PORTION
60A FIRST SPACER
60B SECOND SPACER
61 SECOND HOLE PORTION
62 THIRD HOLE PORTION
70 VALVE BODY HOLDING MEMBER
71 ANNULAR STEP PORTION
80 CHECK VALVE
90 PIEZOELECTRIC ELEMENT
100 AXIS

The invention claimed is:

1. A pump comprising:

a first plate-shaped body;

a second plate-shaped body facing the first plate-shaped body;

a third plate-shaped body located on an opposite side to a side on which the second plate-shaped body is located when viewed from the first plate-shaped body, and facing the first plate-shaped body;

a first peripheral wall portion connecting a peripheral edge portion of the first plate-shaped body and a peripheral edge portion of the second plate-shaped body to each other;

a second peripheral wall portion connecting the peripheral edge portion of the first plate-shaped body and a peripheral edge portion of the third plate-shaped body to each other;

a first pump chamber located between the first plate-shaped body and the second plate-shaped body, and defined by the first plate-shaped body, the second plate-shaped body, and the first peripheral wall portion;

a second pump chamber located between the first plate-shaped body and the third plate-shaped body, and defined by the first plate-shaped body, the third plate-shaped body, and the second peripheral wall portion; and a driving body causing a pressure fluctuation, by causing the first plate-shaped body to undergo bending vibration, in both of the first pump chamber and the second pump chamber, wherein the first plate-shaped body is provided with a plurality of first hole portions, and a check valve is attached to each of the plurality of first hole portions, each of the plurality of first hole portions is arranged, when viewed along an extending direction of an axis extending through a center of the first plate-shaped body, in a region not overlapping with the axis, at least one of the second plate-shaped body and the first peripheral wall portion is provided with one or a plurality of second hole portions, and no check valve is attached to each of the one or plurality of second hole portions, and at least one of the third plate-shaped body and the second peripheral wall portion is provided with one or a plurality of third hole portions, and no check valve is attached to each of the one or plurality of third hole portions.

2. The pump according to claim 1, wherein the one or plurality of second hole portions is arranged in a region not overlapping with each of the plurality of first hole portions, when viewed along the extending direction of the axis.

3. The pump according to claim 1, wherein the one or plurality of third hole portions is arranged in a region not overlapping with each of the plurality of first hole portions, when viewed along the extending direction of the axis.

4. The pump according to claim 1, wherein the driving body causes the first plate-shaped body to undergo bending vibration so as to generate a standing wave in the first plate-shaped body with the axis as the center of the first plate-shaped body such that an antinode of vibration is provided in the center of the first plate-shaped body, and each of the plurality of first hole portions is arranged in a region not overlapping with a node of vibration provided in the first plate-shaped body.

5. The pump according to claim 4, wherein the plurality of first hole portions is annularly arranged, in a point sequence shape, at positions between a circumference of the first plate-shaped body and the axis with the axis as the center of the first plate-shaped body, when viewed along the extending direction of the axis.

6. The pump according to claim 5, wherein a distance between adjacent first hole portions of the plurality of first hole portions is smaller than a distance between the axis and each of the plurality of first hole portions.

7. The pump according to claim 4, wherein the first plate-shaped body is caused to undergo bending vibration by the driving body such that an antinode of vibration is provided also at a position excluding the center of the first plate-shaped body.

8. The pump according to claim 7, wherein at least one of the plurality of first hole portions is arranged in a region overlapping with the antinode of vibration formed at the position excluding the center of the first plate-shaped body.

9. The pump according to claim 8, wherein each of the plurality of first hole portions is arranged in the region overlapping with the antinode of vibration provided at the position excluding the center of the first plate-shaped body.

10. The pump according to claim 7, wherein each of the plurality of first hole portions is arranged in a region in an outer side portion relative to a node of vibration provided at a position farthest from the center of the first plate-shaped body, among nodes of vibration provided in a region excluding the peripheral edge portion of the first plate-shaped body.

11. The pump according to claim 7, wherein the one or plurality of second hole portions is arranged in a region not overlapping with the antinode of vibration at a position excluding the center of the first plate-shaped body.

12. The pump according to claim 11, wherein the one or plurality of second hole portions is arranged in a region overlapping with the node of vibration provided in the first plate-shaped body, when viewed along the extending direction of the axis.

13. The pump according to claim 7, wherein the one or plurality of third hole portions is arranged in a region not overlapping with the antinode of vibration at a position excluding the center of the first plate-shaped body.

14. The pump according to claim 13, wherein the one or plurality of third hole portions is arranged in a region overlapping with the node of vibration provided in the first plate-shaped body, when viewed along the extending direction of the axis.

15. The pump according to claim 1, wherein the driving body causes the first plate-shaped body to undergo bending vibration so as to generate a standing wave in the first plate-shaped body with the axis as the center of the first plate-shaped body such that an antinode of vibration is provided in the center of the first plate-shaped body, each of the plurality of first hole portions is arranged in a region not overlapping with a node of vibration provided in the first plate-shaped body, the one or plurality of second hole portions includes a plurality of the second hole portions, the one or plurality of third hole portions includes a plurality of the third hole portions, the plurality of first hole portions is annularly arranged, in a point sequence shape, at positions between a circumference of the first plate-shaped body and the axis with the axis as the center of the first plate-shaped body, when viewed along the extending direction of the axis, the plurality of second hole portions is annularly arranged, in a point sequence shape, at positions between a circumference of the first plate-shaped body and the axis with the axis as the center of the first plate-shaped body, when viewed along the extending direction of the axis, and the plurality of third hole portions is annularly arranged, in a point sequence shape, at positions between a circumference of the first plate-shaped body and the axis with the axis as the center of the first plate-shaped body, when viewed along the extending direction of the axis.

16. The pump according to claim 15, wherein the plurality of second hole portions is all arranged in a region not overlapping with each of the plurality of first hole portions when viewed along the extending direction of the axis, and the plurality of third hole portions is all arranged in a region not overlapping with each of the plurality of first hole portions when viewed along the extending direction of the axis.

17. The pump according to claim 16, wherein the first plate-shaped body is caused to undergo bending vibration by the driving body such that one antinode of vibration is provided in a radial direction of the first plate-shaped body also at a position excluding the center of the first plate-shaped body, a distance between the antinode of vibration provided at the position excluding the center of the first plate-shaped body and the plurality of second hole portions, in a direction orthogonal to the axis, is greater than a distance between the antinode of vibration provided at the position excluding the center of the first plate-shaped body and the plurality of first hole portions, and a distance between the antinode of vibration provided at the position excluding the center of the first plate-shaped body and the plurality of third hole portions, in the direction orthogonal to the axis, is greater than the distance between the antinode of vibration provided at the position excluding the center of the first plate-shaped body and the plurality of first hole portions.

18. The pump according to claim 17, wherein each of the plurality of first hole portions is arranged in a region overlapping with the antinode of vibration provided at the position excluding the center of the first plate-shaped body, each of the plurality of second hole portions is arranged in a region overlapping with the node of vibration provided in the first plate-shaped body when viewed along the extending direction of the axis, and each of the plurality of third hole portions is arranged in a region overlapping with the node of vibration provided in the first plate-shaped body when viewed along the extending direction of the axis.

19. The pump according to claim 15, wherein each of the plurality of second hole portions is arranged in the first peripheral wall portion, and each of the plurality of third hole portions is arranged in the second peripheral wall portion.

20. The pump according to claim 15, wherein the driving body causes the second plate-shaped body to undergo bending vibration so as to generate a standing wave in the second plate-shaped body with the axis as a center of the second plate-shaped body such that an antinode of vibration is provided in the center of the second plate-shaped body, and causes the third plate-shaped body to undergo bending vibration so as to generate a standing wave in the third plate-shaped body with the axis as a center of the third plate-shaped body such that an antinode of vibration is provided in the center of the third plate-shaped body.

21. The pump according to claim 15, wherein the driving body causes the second plate-shaped body to undergo bending vibration so as to generate a standing wave in the second plate-shaped body with the axis as a center of the second plate-shaped body such that an antinode of vibration is provided in the center of the second plate-shaped body, and causes the third plate-shaped body to undergo bending vibration so as to generate a standing wave in the third plate-shaped body with the axis as a center of the third plate-shaped body such that an antinode of vibration is provided in the center of the third plate-shaped body, the second plate-shaped body is caused to undergo bending vibration by the driving body such that an antinode of vibration is provided also at a position excluding the center of the second plate-shaped body, the third plate-shaped body is caused to undergo bending vibration by the driving body such that an antinode of vibration is provided also at a position excluding the center of the third plate-shaped body, each of the plurality of second hole portions is arranged in a region, of the second plate-shaped body, in an outer side portion relative to an antinode of vibration provided at a position farthest from the center of the second plate-shaped body, and each of the plurality of third hole portions is arranged in a region, of the third plate-shaped body, in an outer side portion relative to an antinode of vibration provided at a position farthest from the center of the third plate-shaped body.

22. The pump according to claim 1, wherein a hole other than the first hole portion, the second hole portion, and the third hole portion is not provided in any of the first plate-shaped body, the second plate-shaped body, the third plate-shaped body, the first peripheral wall portion, and the second peripheral wall portion.

23. The pump according to claim 1, wherein the driving body includes a piezoelectric element having a substantially flat plate shape, and the piezoelectric element is affixed to the center of the first plate-shaped body.

24. The pump according to claim 23, wherein each of the plurality of first hole portions is arranged in an outer side portion relative to the piezoelectric element, when viewed along the extending direction of the axis.

* * * * *